US012410567B2

(12) United States Patent
Menzenbach

(10) Patent No.: US 12,410,567 B2
(45) Date of Patent: Sep. 9, 2025

(54) GROUND MILLING MACHINE, IN PARTICULAR STABILISER OR RECYCLER, AND METHOD OF OPERATING A GROUND MILLING MACHINE

(71) Applicant: Wirtgen GmbH, Windhagen (DE)

(72) Inventor: Christoph Menzenbach, Neustadt (DE)

(73) Assignee: Wirtgen GmbH, Windhagen (DE)

( * ) Notice: Subject to any disclaimer, the term of this patent is extended or adjusted under 35 U.S.C. 154(b) by 394 days.

(21) Appl. No.: 18/059,284

(22) Filed: Nov. 28, 2022

(65) Prior Publication Data

US 2023/0175213 A1 Jun. 8, 2023

(51) Int. Cl.
*E01C 23/088* (2006.01)

(52) U.S. Cl.
CPC ..... *E01C 23/088* (2013.01)

(58) Field of Classification Search
CPC ..... E01C 23/088; E01C 21/00; E01C 23/065
See application file for complete search history.

(56) References Cited

U.S. PATENT DOCUMENTS

| | | | | |
|---|---|---|---|---|
| 5,354,147 | A | 10/1994 | Swisher, Jr. | |
| 7,448,309 | B2 | 11/2008 | Bitter | |
| 8,944,517 | B2 * | 2/2015 | Franzmann | E01C 23/088 299/1.5 |
| 10,041,215 | B2 | 8/2018 | Muir et al. | |
| 10,494,778 | B2 | 12/2019 | Menzenbach et al. | |
| 10,704,213 | B2 | 7/2020 | Gerhardy et al. | |
| 11,453,984 | B2 | 9/2022 | Muir et al. | |
| 2016/0356004 | A1 | 12/2016 | Berning et al. | |
| 2019/0161924 | A1 * | 5/2019 | Gerhardy | E01C 23/127 |
| 2021/0317621 | A1 | 10/2021 | Doy et al. | |
| 2022/0316156 | A1 | 10/2022 | Berning et al. | |

FOREIGN PATENT DOCUMENTS

| | | | |
|---|---|---|---|
| DE | 102004012382 | B4 | 3/2014 |
| DE | 102012012397 | A1 | 4/2014 |
| DE | 102017110146 | A1 | 11/2017 |

(Continued)

OTHER PUBLICATIONS

European search report in the corresponding patent application No. 22210922.5, dated May 9, 2023, 5 pages (not prior art).

(Continued)

*Primary Examiner* — Carib A Oquendo
(74) *Attorney, Agent, or Firm* — Lucian Wayne Beavers; Patterson Intellectual Property Law, PC

(57) ABSTRACT

A roller flap position correction mode can be activated manually or automatically. In the roller flap position correction mode, the position of the rear roller flap is optimised so that an accumulation of material is largely avoided. The control device of the roller flap adjustment device is designed in such a way that in the roller flap correction mode, the floating position of the rear roller flap is cancelled in a first step and the rear roller flap is pivoted upwards from a first pivoted position into a second pivoted position. In a second step, the floating position is set again, so that the rear roller flap assumes a third pivoted position in which the lower edge of the rear roller flap rests on the ground. After the floating position has been reset, a checking routine is carried out, which includes at least one checking cycle.

16 Claims, 16 Drawing Sheets

(56) References Cited

FOREIGN PATENT DOCUMENTS

| | | | |
|---|---|---|---|
| DE | 102017010919 | A1 | 5/2019 |
| DE | 102021108487 | A1 | 10/2021 |
| DE | 102021130386 | A1 | 5/2022 |
| DE | 102021108367 | A1 | 10/2022 |
| EP | 2840183 | B1 | 1/2016 |
| EP | 2977514 | B1 | 7/2017 |
| EP | 4067573 | A1 | 10/2022 |

OTHER PUBLICATIONS

German Office Action for corresponding patent application No. 10 2021 131 906.4, dated Dec. 5, 2023, 10 pages (not prior art).

* cited by examiner

GROUND MILLING MACHINE, IN PARTICULAR STABILISER OR RECYCLER, AND METHOD OF OPERATING A GROUND MILLING MACHINE

BACKGROUND OF THE DISCLOSURE

The invention relates to a ground milling machine, in particular a stabiliser or recycler, having a machine frame which is supported by running gears and on which is arranged a milling/mixing roller arranged in a roller housing which is open at the bottom and has a roller flap at the rear in the working direction which can be pivoted about a pivot axis extending transversely to the longitudinal direction of the ground milling machine. In addition, the invention relates to a method for operating such a ground milling machine.

DESCRIPTION OF THE PRIOR ART

For stabilising ground with insufficient load-bearing capacity, stabilisers are known by which a powdered or liquid binding agent is introduced into the ground in order to increase its load-bearing capacity. Self-propelled and non-self-propelled stabilisers are known which are attached to or towed by a towing vehicle. The known recyclers differ from the stabilisers in that the recyclers are used not only for improvement or solidification of ground, but also for remediation of damaged surface layers of roads or paths.

Stabilisers or recyclers have a machine frame on which a milling/mixing roller is arranged for milling the ground to be stabilised or the road surface layer to be remediated, which is located in a roller housing which is open at the bottom. The roller housing has a roller flap at the front in the working direction and a roller flap at the rear in the working direction, and these flaps can be pivoted about a pivot axis running transversely to the longitudinal direction of the machine frame. The roller housing is closed at the sides by side parts extending in the longitudinal direction.

The volume enclosed by the roller housing forms a mixing chamber for the milled material and the binding agent. One or more dosing devices are located on the roller housing, which provide a predetermined amount of possibly different binding agents or water for the volume of the mixing chamber.

To pivot the front and rear roller flap, a roller flap adjustment device is provided which has at least one actuator for pivoting the front or rear roller flap and a control device for actuating the at least one actuator, so that the lower edge of the front or rear roller flap is adjustable in height relative to the ground. The control device of the rear roller flap is designed in such a way that the at least one actuator is controlled during milling operation in such a way that the rear roller flap lies in a floating position with a predetermined contact force on the ground.

In addition, the known stabilisers or recyclers have a milling/mixing roller adjustment device which is designed in such a way that the height of the milling/mixing roller relative to the machine frame can be adjusted, so that the milling depth can be changed.

When the milling/mixing roller is applied and the milling operation is started, and also when the milling depth is increased during the milling operation, the rear roller flap, even in the floating position, exerts considerable counter-pressure on the material in the roller housing. Practice has shown that this counter-pressure can lead to an accumulation of material in the mixing chamber. If there is an accumulation of material, the mixing ratio of material and binding agent can no longer meet the specifications. Another disadvantage is that higher power is required to operate the milling/mixing roller or the milling process can only be carried out at a lower working speed.

Raising the lower edge of the rear roller flap after the application of the milling/mixing roller or after the increase in the milling depth can facilitate the outflow of accumulated material from the roller housing as the ground milling machine advances. However, if the rear roller flap is opened too far, there is a risk that material will be thrown backwards out of the roller housing.

SUMMARY OF THE DISCLOSURE

The object of the invention is to improve the operation of a ground milling machine or its working result, in particular when applying the milling/mixing roller to start milling or when increasing the milling depth during milling. One object of the invention is, in particular, to avoid an accumulation of material when applying the milling/mixing roller or when increasing the milling depth, or to ensure an optimal mixing ratio of milled material and binding agent. A further object of the invention is to avoid an increase in the power required to operate the milling/mixing roller or a reduction in the working speed when applying the milling/mixing roller or when increasing the milling depth Another object of the invention is to provide a method with which a ground milling machine can be operated, in particular when applying the milling/mixing roller to start milling or when increasing the milling depth during milling to avoid an accumulation of material.

According to the invention, these objects are achieved by the features of the independent claims. The dependent claims relate to advantageous embodiments of the invention.

The ground milling machine according to the invention, in particular a stabiliser or recycler, and the method according to the invention are characterised by a roller flap position correction mode, which can be activated manually after the milling/mixing roller has been applied and the ground milling machine has started up or during the actual milling operation after the milling depth has been increased or activated automatically. The roller flap position correction mode comprises at least one roller flap position correction cycle to optimise the position of the rear roller flap so that an accumulation of material and the problems resulting therefrom are largely avoided. The roller flap position correction mode can be activated manually by the machine operator or can be started fully automatically, so that manual intervention is not necessary. Manual intervention is not required while operating the ground milling machine in the roller flap position correction mode. After the roller flap position has been corrected, the roller flap position correction mode can be deactivated again automatically.

The control device of the roller flap adjustment device is designed in such a way that in the at least one roller flap correction cycle, the floating position of the rear roller flap is cancelled in a first step and the rear roller flap is pivoted upwards from a first pivoted position into a second pivoted position, so that the lower edge of the rear roller flap is raised. Consequently, the material accumulated in the roller housing can flow out. The pivot angle by which the roller flap is pivoted upwards can be specified by the control device. The roller housing should be opened wide enough so that accumulated material can flow out of the roller housing unhindered, on the one hand, but not so wide that there is a greater risk of material being thrown out, on the other hand.

In a second step, after the rear roller flap has assumed the second pivoted position, the floating position is set again so that the rear roller flap assumes a third pivoted position in which the lower edge of the rear roller flap rests on the ground.

A preferred embodiment provides that the at least one roller flap position correction cycle includes a checking routine.

The basic principle of the checking routine is to monitor the movement of the roller flap after the floating position has been restored.

The checking routine provides for comparing a variable correlating with the third pivoted position with a threshold value or comparing a variable correlating with the third pivoted position with the value of a variable correlating with the first pivoted position, wherein the roller flap position correction mode is deactivated on the basis of a comparison of the value of a variable correlating with the third pivoted position with a threshold value or on the basis of a comparison of the value of a variable correlating with the third pivoted position with the value of a variable correlating with the first pivoted position.

If the raised roller flap falls back into a lower position after the floating position has been reset, i.e. it does not remain in the raised position, it is assumed that a continuous flow of material has been established, in which the milled material that accumulates in the mixing chamber and the material flowing out of the mixing chamber under the roller flap is in a state of equilibrium, so that an accumulation of material does not occur. In particular, it can be checked whether the roller flap drops back into the position from which it was raised. In this case, the roller flap position correction mode can be deactivated.

A threshold value can be defined for the movement of the roller flap. If the roller flap movement after resetting of the floating position is less than or equal to the threshold, i.e. the roller flap has not fallen back by a predetermined amount, another roller flap position correction cycle is carried out. If, on the other hand, the movement of the roller flap is greater than the threshold value, i.e. the roller flap has fallen back by a predetermined amount, the roller flap position correction mode is deactivated.

The variable correlating with the pivoted positions can be a variable that can be easily detected with little technical effort. The evaluation of the values of this variable depends on whether the variable increases or decreases as the roller flap is raised. For example, if the variable is a pivot angle, the evaluation depends on which angle is defined as the pivot angle. Different mathematical methods can be used to compare the variables correlating with the pivoted positions before and after the milling flap is raised.

A preferred embodiment provides that the variable correlating with the first and third pivoted position is a variable correlating with the height of the lower edge of the rear roller flap. The value of this variable increases when the roller flap is opened. In this embodiment, the roller flap position correction cycles are carried out until it is determined at least once that the height of the lower edge of the rear roller flap in the third pivoted position is equal to or less than the height of the lower edge of the rear roller flap in the first pivoted position. On the other hand, a further roller flap position correction cycle is carried out if the height of the lower edge of the rear roller flap in the third pivoted position is greater than the height of the lower edge of the rear roller flap in the first pivoted position. Consequently, the roller flap position correction mode can be terminated after only one or more roller flap position correction cycles. The roller flap position correction mode can therefore only include one roller flap position correction cycle if it is to be checked only once that the lower edge of the rear roller flap in the third pivoted position is equal to or less than the height of the lower edge of the rear roller flap in the first pivoted position, and this is also the case. However, the repeated determination of these conditions has the advantage that the roller flap position correction mode is only deactivated when a state of equilibrium has been set permanently.

The height of the lower edge of the roller flap is a variable related to a reference plane, which may be the unmilled ground. If the height of the ground in relation to the machine frame or to the roller housing is known, the height of the lower edge of the roller flap can be determined from the height of the roller flap in relation to the machine frame or the roller housing.

The at least one actuator of the roller flap adjustment device can be a piston-cylinder arrangement that acts on the roller flap and, for detection of the variable correlating with the first and/or third pivoted position, a measuring unit, in particular a distance sensor, can be provided that detects the position of the piston of the piston-cylinder arrangement. For example, the piston of the piston-cylinder arrangement can be pivotally attached to the machine frame and the cylinder can be pivotally attached to the roller flap, or vice versa. This embodiment can be easily implemented without major technical effort. In this embodiment, the pivoted positions can be compared simply by comparing the stroke of the piston when lifting with the stroke of the piston when lowering. If the piston is extended during lowering by a smaller distance than the piston was retracted when raising the roller flap, i.e. the roller flap maintains its upper position or is raised even further by the material flow, another roller flap position correction cycle is carried out. If, on the other hand, the roller flap falls back into a lower position after being raised due to the absence of a material flow, the checking is terminated.

The control device of the roller flap adjustment device is preferably designed in such a way that the floating position is set again in the second step after a predetermined time interval has elapsed or after a predetermined distance has been covered after the floating position has been cancelled or the roller flap has been pivoted into the third pivoted position. The time interval or the distance can be measured taking into account the dynamic conditions in relation to the material flow during milling.

The pivot angle by which the roller flap is pivoted upwards depends on the volume of the milled material. A further preferred embodiment provides a memory in which a pivot angle or a variable correlating with the pivot angle by which the rear roller flap is pivoted from the first into the second pivoted position is stored for different milling depths, the control device of the roller flap adjustment device being designed in such a way that, depending on the set milling depth, the pivot angle or a variable correlating with the pivot angle is read from the memory.

For manual activation of the roller flap position correction mode, the control device of the roller flap adjustment device can have an operating element, for example a knob or switch or a button on a touch-sensitive screen (touch screen), the control device being designed in such a way that the roller flap position correction mode is activated by actuation of the operating element.

The control device of the roller flap adjustment device can also be designed in such a way that the roller flap position correction mode is activated fully automatically when, after the ground milling machine has started up milling operation, a predetermined time interval has elapsed or the ground milling machine has covered a predetermined distance. The point in time at which the ground milling machine starts up can be determined by monitoring control signals that can be made available by the central control and computing device of the ground milling machine, or by acquiring measured values from suitable sensors, for example distance sensors.

Since a ground milling machine generally has a milling/mixing roller adjustment device that is designed in such a way that the height of the milling/mixing roller relative to the machine frame can be adjusted so that the milling depth can be changed, the control device for the roller flap adjustment device can be designed in such a way that the roller flap position correction mode is activated when the milling/mixing roller adjustment device has increased the milling depth by a predetermined value during the milling operation and after the increase in the milling depth a predetermined time interval has elapsed or the milling/mixing roller adjustment device has increased the milling depth by a predetermined value during the milling operation and after the increase in the milling depth the ground milling machine has covered a predetermined distance. The time interval or the distance can be measured taking the dynamic conditions during the milling operation into account. The milling/mixing roller can be adjusted in height relative to the machine frame, the machine frame being supported by lifting columns which are fastened to running gears, so that the height of the machine frame can be adjusted relative to the ground.

BRIEF DESCRIPTION OF THE DRAWINGS

Embodiments of the invention are described in detail below with reference to the drawings.

In the drawings.

DETAILED DESCRIPTION

Figure 1:
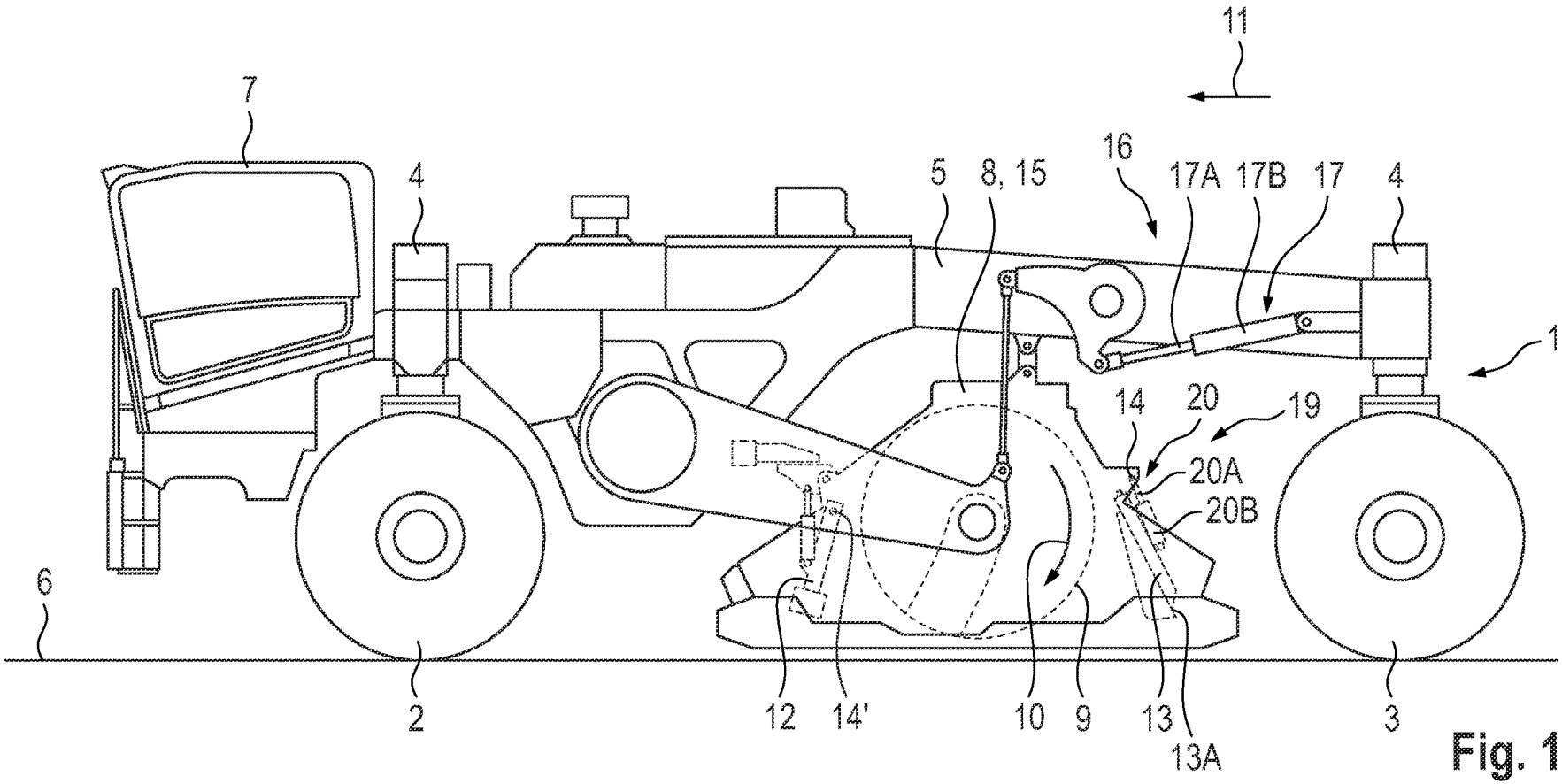
FIG. 1 shows an embodiment of a ground milling machine according to the invention in a partially sectional view.

FIG. 1 shows a side view of a ground milling machine according to the invention, which is described in detail in EP 2 977 514 B1. The ground milling machine has a chassis 1 which comprises two front running gears 2 and two rear running gears 3. In the present embodiment, the running gears 2, 3 are wheels. Lifting columns 4 are fastened to each of the running gears 2, 3 and carry a machine frame 5, so that the height of the machine frame relative to the ground 6 can be adjusted. The driver's platform 7 is located on the machine frame 5 in front of the front running gears 2 in the working direction 11. A roller housing 8 which is open at the bottom and in which a milling/mixing roller 9 is located is arranged on the machine frame 5 between the running gears. The direction of rotation of the milling/mixing roller is marked with an arrow 10. The roller housing 8 has a roller flap 12 at the front in the working direction 11 and a roller flap 13 at the rear in the working direction, which can each be pivoted about a pivot axis 14' or 14 respectively running transversely to the longitudinal direction of the machine frame. The roller housing is closed at the sides by side parts 15 extending in the longitudinal direction, which are only shown in outline in FIG. 1. The milling/mixing roller 9 may also be referred to as a milling drum 9. The roller housing 8 may also be referred to as a milling drum housing 8.

Figure 2:
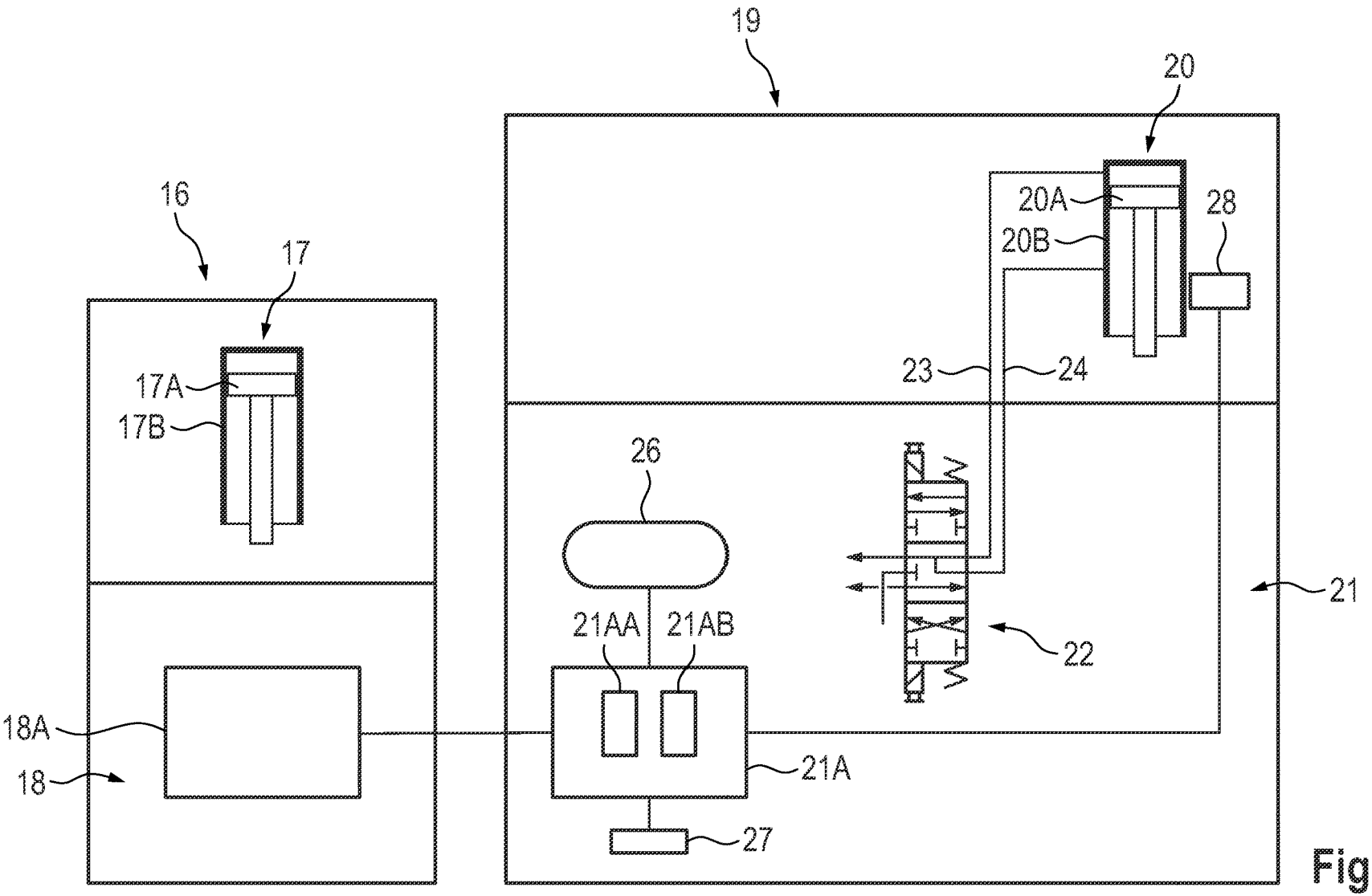
FIG. 2 is a diagram to illustrate the structure of the roller flap adjustment device and the milling/mixing roller adjustment device.

To adjust the height of the milling/mixing roller 9, the ground milling machine has a milling/mixing roller adjustment device 16, which in the present embodiment comprises a piston-cylinder arrangement 17 with a piston 17A and a cylinder 17B. The piston-cylinder arrangement 17 may also be referred to as a roller adjustment actuator 17 for adjusting the height of the milling/mixing roller 9 relative to the machine frame 5. By actuation of the piston 17A of the piston-cylinder arrangement 17, the height of the milling/mixing roller 9 can be adjusted relative to the machine frame 5 or the ground 6, with the axis of the milling/mixing roller moving on a circular path. A height adjustment of the milling/mixing roller 9 relative to the ground 6 is also possible by retracting or extending the lifting columns 4. To control the piston-cylinder arrangement 17 of the milling/mixing roller adjustment device 16, a control device 18 (not shown in FIG. 1) is provided, which comprises a control and computing unit 18A which can form a separate control and computing unit or can be a component of a central control and computing device (not shown) of the ground milling machine (FIG. 2).

A front and rear roller flap adjustment device 19 is provided to adjust the position of the roller flaps 12, 13 at the front and rear in the working direction. In the embodiments described below, only the rear roller flap is considered.

The roller flap adjustment device 19 of the rear roller flap 13 has at least one actuator 20 acting on the roller flap. In the present embodiment, the actuator is a piston-cylinder arrangement 20, of which the piston 20A is pivotally attached to the machine frame 5 and of which the cylinder 20B is pivotally attached to the rear roller flap 13.

Figure 3A:
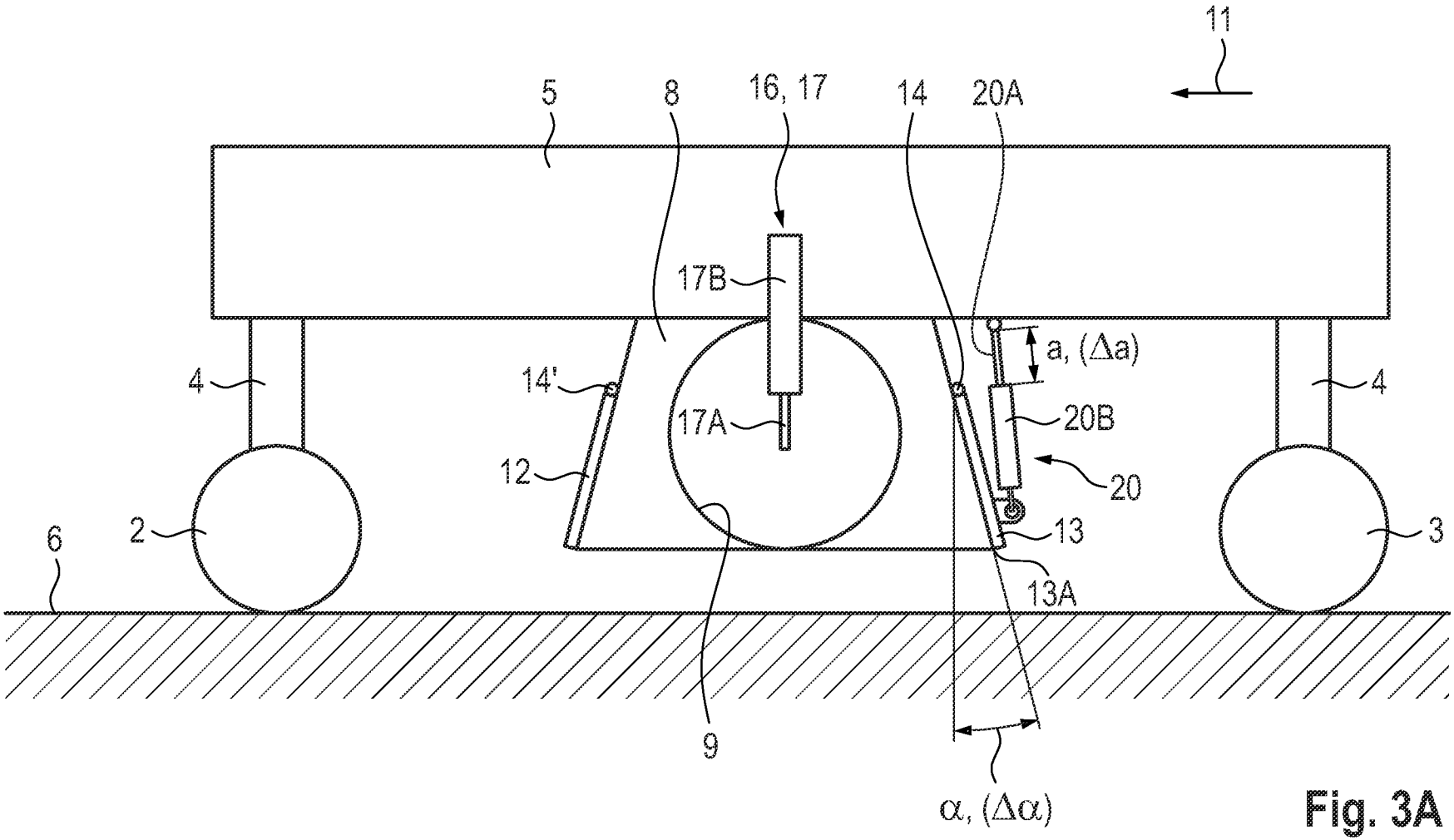
FIG. 3A to 3N show the ground milling machine in a highly simplified schematic representation with the different positions of the rear roller flap when starting and operating the ground milling machine.

By moving the piston 20A of the piston-cylinder arrangement 20 to a specific position, which is hereinafter designated as a, or by retracting or extending the piston 20A from an initial position by a predetermined distance, which is hereinafter designated as $\Delta a$, the rear roller flap 13 can be pivoted upwards or downwards about the pivot axis 14 running transversely to the working direction into a predetermined pivoted position $\alpha$ or by a predetermined pivot angle $\Delta\alpha$, which correlates with the distance $\Delta a$, so that the lower edge 13A of the roller flap 13 can be raised or lowered relative to the ground 6 (FIG. 3A).

To control the actuator 20, the roller flap adjustment device 19 has a control device 21 (not shown in FIG. 1) which comprises a control and computing unit 21A which can form a separate control and computing unit or can be a component of the central control and computing device of the ground milling machine (FIG. 2). The control and computing unit 21A may also be referred to as a controller 21A.

The control and computing unit 21A of the control device 21 of the roller flap adjustment device 19 can have, for example, a general processor, a digital signal processor (DSP) for continuously processing digital signals, a microprocessor, an application-specific integrated circuit (ASIC), an integrated circuit consisting of logic elements (FPGA) or other integrated circuits (IC) or hardware components, in order to control the actuators. A data processing program (software) can run on the hardware components. A combination of the different components is also possible.

The roller flap adjustment device 19 also includes other components known to a person skilled in the art, in particular hydraulic components, for example hydraulic pumps, hydraulic valves, hydraulic lines.

In addition, the ground milling machine has a drive device (not shown) for hydraulic components, for example hydraulic pumps or hydraulic motors, for example for driving the running gears.

The control of the rear roller flap 13 by the control device 21 of the roller flap adjustment device 19 is described in detail below with reference to FIG. 3A to 3N, in which the parts which correspond to one another are provided with the same reference signs. Firstly, the application of the milling/mixing roller 9 to begin the milling operation is described.

Figure 3B:
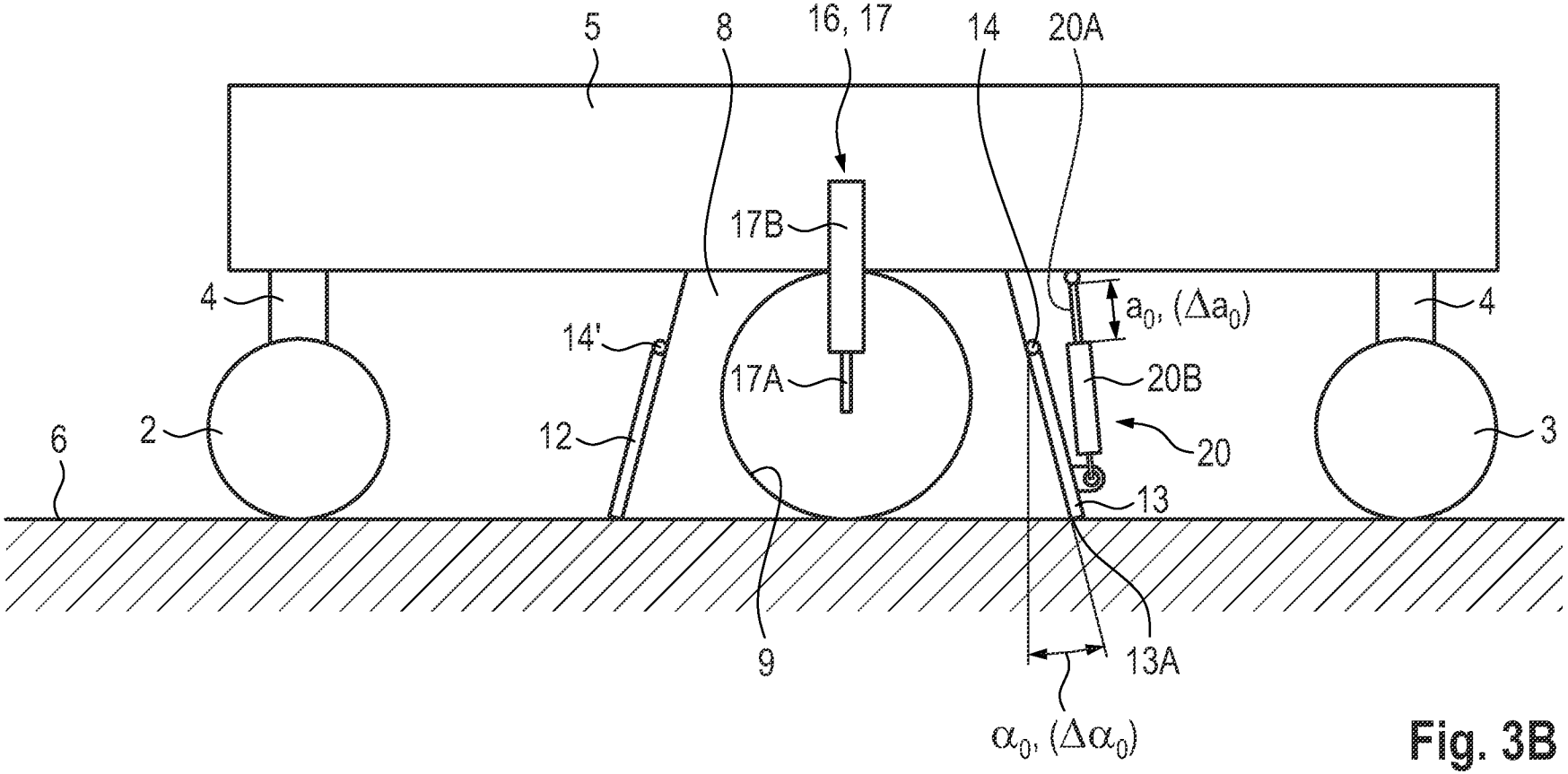

For application of the milling/mixing roller 9, the machine operator moves the ground milling machine to the desired position with the milling/mixing roller 9 raised. In this position, the lifting columns 4 are largely extended and the milling/mixing roller 9 is moved into an upper position (FIG. 3A). The lifting columns 4 are then largely retracted and the milling/mixing roller 9 is brought into a position in which it touches the ground 6. This process is also known as scraping or scratching. In this position, the piston 20A of the piston-cylinder arrangement 20 is in the "$a_0$" position and the roller flap 13 is in the pivoted position "$\alpha_0$" (FIG. 3B). When the milling/mixing roller 9 touches the ground 6, a zero adjustment takes place for the milling/mixing roller adjustment device 16, so that further lowering of the milling/mixing roller or movement of the piston 17A of the piston-cylinder arrangements 17 of the milling/mixing roller adjustment device 16 by a predetermined distance corresponds to the milling depth. It should be noted that the change in length of the piston-cylinder arrangement does not necessarily have to correspond to a change in milling depth in a ratio of 1:1. The change in milling depth can be calculated from the stroke of the piston 17A, taking the geometric conditions into account. With the zero adjustment a reference plane is established which corresponds to the surface of the unmilled ground 6. The milling depth can thus be adjusted via the distance to be covered by which the milling/mixing roller 9 is lowered in relation to the machine frame 5 or the ground surface or the piston 17A is moved in or out, or the milling depth can be determined from the distance covered when lowering the milling/mixing roller or moving the piston. The distance travelled can be detected with the known distance sensors.

Figure 3C:
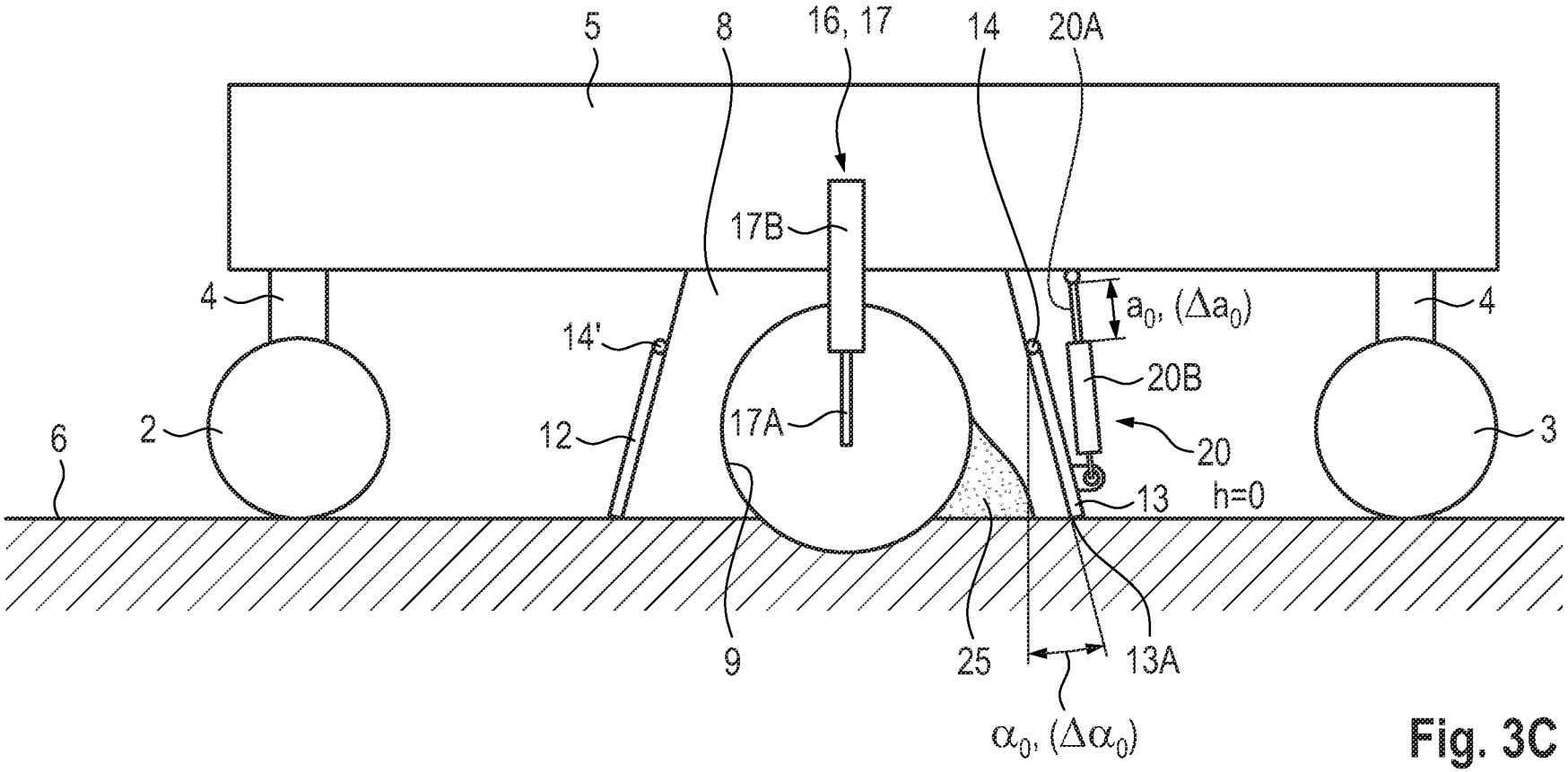

The milling/mixing roller 9 is now lowered to the desired milling depth so that the milling process begins (FIG. 3C). In the lowered position, the rear roller flap 13 is brought into a floating position in which the lower edge 13A of the roller flap rests on the ground 6 with a predetermined contact force, so that the roller housing 8 is closed at the rear (h=0). Hydraulic arrangements for realising a floating position belong to the prior art (DE 10 2004 012 382 B4). The floating position of the rear roller flap 13 may also be referred to as a floating mode of the rear roller flap 13.

FIG. 2 shows a simplified hydraulic circuit diagram of an embodiment for realising a floating position for the piston-cylinder arrangement 20 of the roller flap adjustment device 19. In the floating position, for lifting and lowering the rear roller flap 13 a hydraulic valve 22 of a hydraulic unit (not shown in more detail) connects the upper and lower cylinder chamber of the piston-cylinder arrangement 20 to a hydraulic tank (not shown) via the hydraulic lines 23, 24 connected to the cylinder connections, so that the system pressure is not applied to the chambers. The hydraulic valve 22 is a 4/3-way valve. The hydraulic lines leading to the hydraulic valve 22 are not shown in FIG. 2 for the sake of simplicity. Since no specific hydraulic force acts on the cylinder, the piston 20A can move in the cylinder 20B, so that the roller flap 13 pivots downwards due to its weight force. By switching of the hydraulic valve 22, the system pressure can be applied to one or the other hydraulic line 23, 24 (pressure line) or one or the other hydraulic line can be connected to the tank (tank line), so that the piston 20A is moved up or down.

The roller flap adjustment device 19 can also be designed in such a way that the roller flap 13 does not rest on the ground under its own weight, but is loaded or relieved of load with an additional contact force. If in the floating position both chambers are subjected to a pressure which preferably does not correspond to the system pressure, the movement of the roller flap downwards can be supported by a corresponding design of the effective contact surfaces of the cylinder, for example with the same pressure in both cylinder chambers.

In principle, the invention can also be implemented by a roller flap adjustment device 19 with a single-acting piston-cylinder arrangement. A single-acting piston-cylinder arrangement is characterised in that it can only be actuated in one direction. The roller flap adjustment device 19 only needs to be able to raise the roller flap. The floating position is achieved in that when no hydraulic pressure is applied to the piston-cylinder arrangement, the roller flap sinks in the direction of gravity under its own weight.

When the ground milling machine is started and moves in the working direction 11, the mixing chamber of the roller housing 8 fills with the milled material, which is deposited behind the milling/mixing roller 9 in the working direction.

Figure 3D:
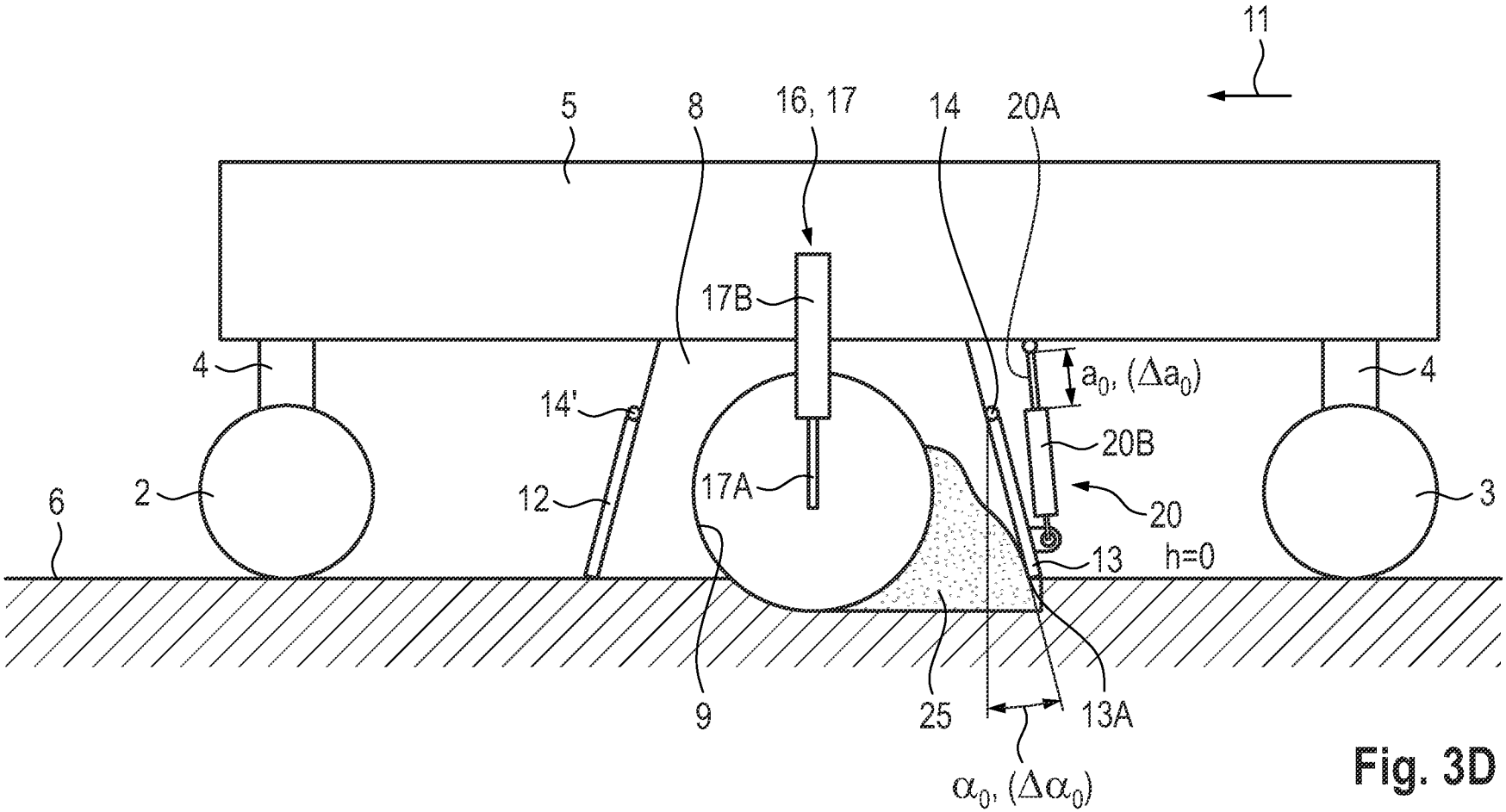
Figure 3E:
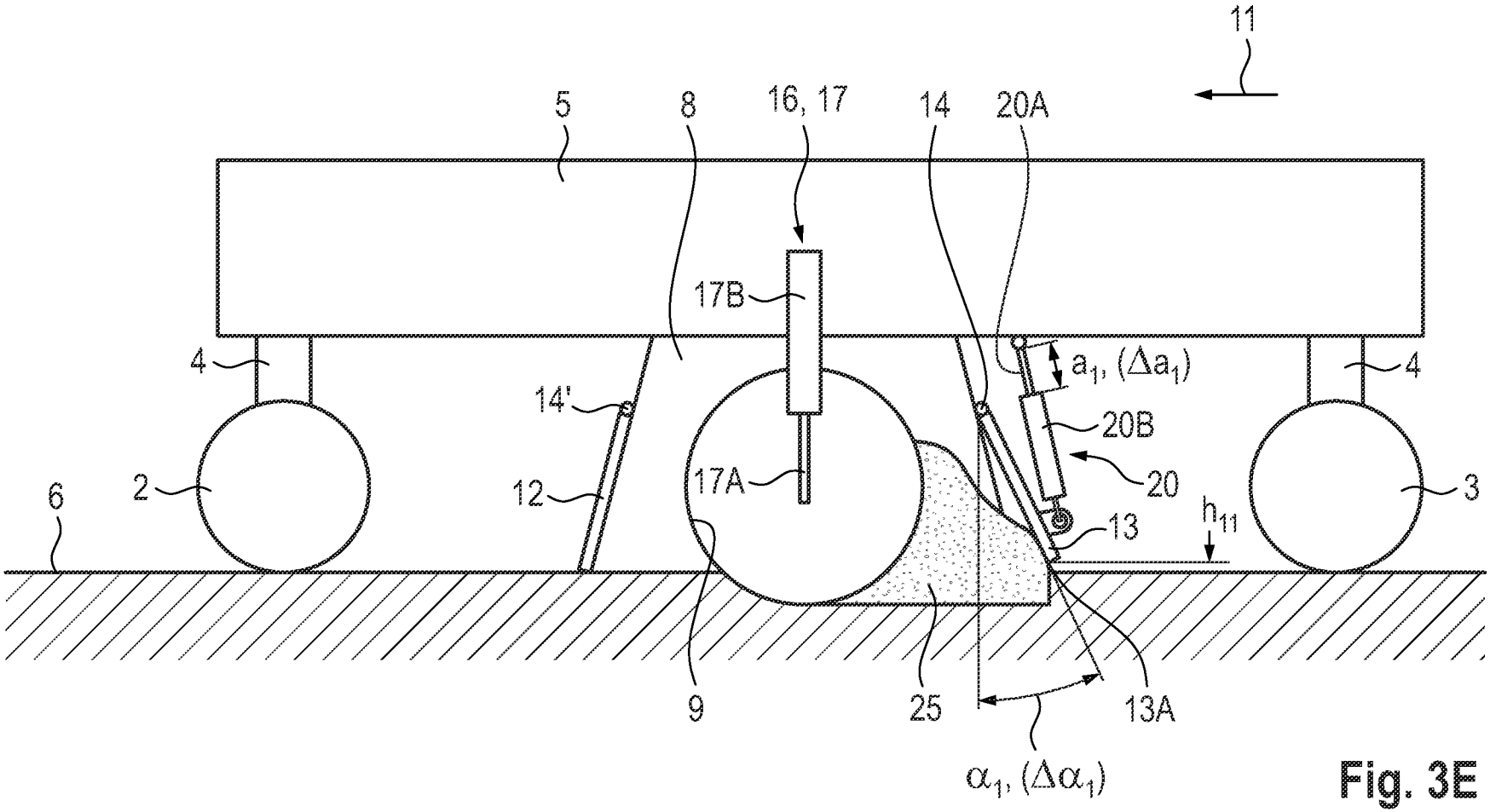

FIGS. 3C and 3D show the roller housing 8 when the milling/mixing roller 9 is applied (FIG. 3C) and after the ground milling machine has started up (FIG. 3D). The piston 20A of the piston-cylinder arrangement 20 is in the "$a_0$" position after application and the roller flap 13 is in the pivoted position "$\alpha_0$", so that the height of the lower edge 13A of the rear roller flap 13 above the unmilled ground 6 forming a reference plane is zero (h=0). It can be seen that the mixing chamber is increasingly filled with milled material 25, with a specific angle of repose being established in accordance with the advancing speed and the material properties. FIG. 3D shows the point in time at which the material 25 has reached the rear roller flap 13. Since the rear roller flap 13 is in the floating position, the rear roller flap can give way, which is indicated in FIG. 3E, if the mixing chamber continues to fill with material as the ground milling machine advances ($a_1$, $\alpha_1$ or $\Delta a_1$, $\Delta\alpha_1$). The aim is that the state of equilibrium shown in FIG. 3F between the milled and deposited material is established, in which the lower edge 13A of the rear roller flap 13 in the floating position rests on the material 25 thrown up to the rear and closes the roller housing 8 at the rear, the material being pulled off from the rear roller flap.

In practice, however, it has been shown that after the milling/mixing roller 9 has been applied, material can accumulate in the roller housing 8 while the ground milling machine is being advanced, since the milling/mixing roller in the floating position exerts a not inconsiderable counter-pressure on the milled material. In the event of an accumulation of material, the mixing ratio of material and binding agent can no longer meet the specifications and the drive power required to drive the milling/mixing roller can increase. In the worst case, accumulated material can impede the movement of the milling/mixing roller to such an extent that the combustion engine of the drive device stalls. The problem described above can also occur when the milling depth is increased during the milling operation.

The control device 21 of the roller flap adjustment device 19 or the central control and computing device of the ground milling machine, which can comprise the control and computing unit of the control device of the roller flap adjustment device, is configured in such a way that the following method steps are carried out. The roller flap adjustment device 19 provides a roller flap position correction mode that can be activated manually or automatically and comprises at least one roller flap position correction cycle.

For manual activation of the roller flap position correction mode, the control device 21 of the roller flap adjustment device 19 has an operating element 26 (FIG. 2) which the machine operator can actuate after the ground milling machine has been started up or a greater milling depth has been set during the milling operation. When the operating element 26 is actuated, a control signal is generated, which is received by the control and computing unit 21A of the control device 21 of the roller flap adjustment device 19.

After the control signal is received, the roller flap position correction mode is switched on, so that a first roller flap position correction cycle is carried out. In the roller flap position correction cycle, the control device switches off the floating position of the rear roller flap 13 and controls the piston-cylinder arrangement 20 of the roller flap adjustment device in such a way that the rear roller flap 13 is pivoted with a first pivot angle $\alpha_1$ (FIG. 3E) out of a first pivoted position (floating position), in which the lower edge 13A of the rear roller flap 13 rests floating on the milled material 25, the height of its lower edge above the ground being $h_{11}$, and is pivoted upwards by the angle $\Delta\alpha_2$ out of the pivoted position "$\alpha 1$" into a second pivoted position with a second pivot angle $\alpha_2$ (height above the ground=$h_{21}$) (FIG. 3G). For this purpose, the piston 20A of the piston-cylinder arrangement 20 is retracted by a predetermined distance $\Delta a_2$, which can be detected by a distance sensor 28 (FIG. 2). The distance $a_2$ or $\Delta a_2$, which is a variable correlating with the pivoted position, in particular the height of the lower edge 13A of the roller flap 13, can be read from a memory 27 (FIG. 2), in which a pivot angle or a distance correlating with the pivot angle is stored for different milling depths to be set. Then, in a second step, the floating position of the rear roller flap 13 is switched on again, so that the rear roller flap 13 assumes a third pivoted position with a third pivot angle $\alpha_3$ (height above the ground=$h_{31}$), in which the lower edge of the roller flap rests on the milled material (FIG. 3H). The piston 20A moves out of the position "$a_2$" into the position "$a_3$" or the piston is extended by $\Delta a_3$.

FIG. 3G shows the point in time at which the rear roller flap 13 has been raised from the first pivoted position ($h_{11}$) (FIG. 3E) into the second pivoted position ($h_{21}$) after the floating position has been cancelled, and FIG. 3H shows the point in time at which the rear roller flap 13 has assumed the third pivoted position ($h_{31}$) after resetting of the floating position. Since milled material has flowed in in the meantime, it can be seen that the third pivoted position (FIG. 3H) largely corresponds to the second pivoting position (FIG. 3G), i.e. $h_{31} \approx h_{21}$ in the present embodiment. In this case, $h_{31}$ is greater than $h_{11}$.

The automatic activation of the roller flap position correction mode is described below. When the ground milling machine is started and the milling depth is greater than zero, the drive device generates a control signal which is received by the control and computing unit 21A of the control device 21 of the roller flap adjustment device 19. After the control signal is received, a timer 21AA or an odometer 21AB is started. The timer and/or the odometer can be a component of the roller flap adjustment device 19, in particular the control and computing unit 21A thereof, or can be other components of the ground milling machine. When the predetermined time interval has expired or the ground milling machine has covered the predetermined distance, the control device 21 switches off the floating position in a first step and pivots the rear roller flap 13 from the first pivoted position (FIG. 3E) upwards into the second pivoted position (FIG. 3G). Then, in a second step, the floating position is switched on again, so that the rear roller flap 13 assumes a third pivoted position (FIG. 3H), in which the lower edge 13A thereof rests on the milled material 25.

The roller flap position correction mode is also activated automatically when the milling/mixing roller adjustment device 16 generates a control signal which signals to the control and computing unit 21A of the control device 21 of the roller flap adjustment device 19 that the milling/mixing roller adjustment device during the milling operation has increased the milling depth by a predetermined value.

Figure 3F:
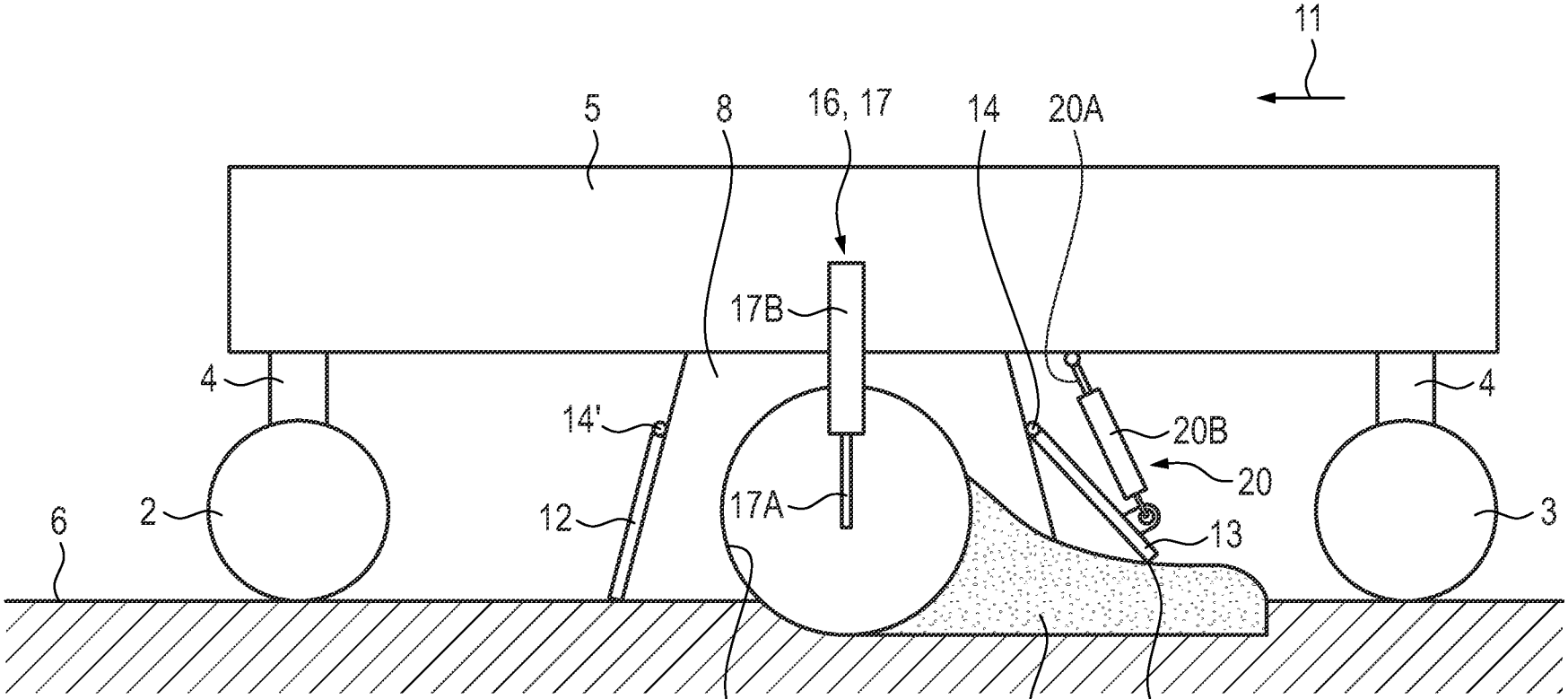
Figure 3G:
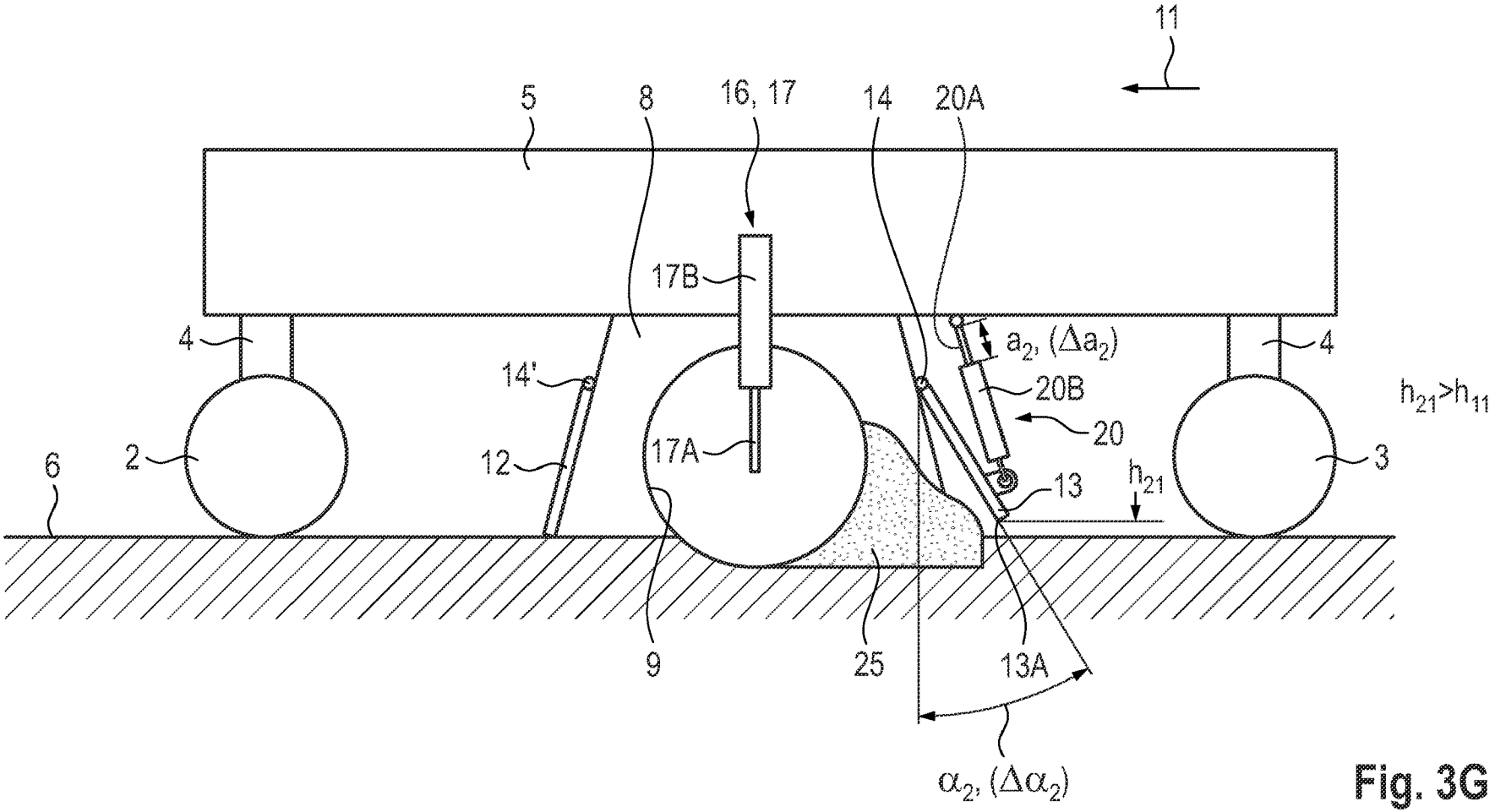
Figure 3H:
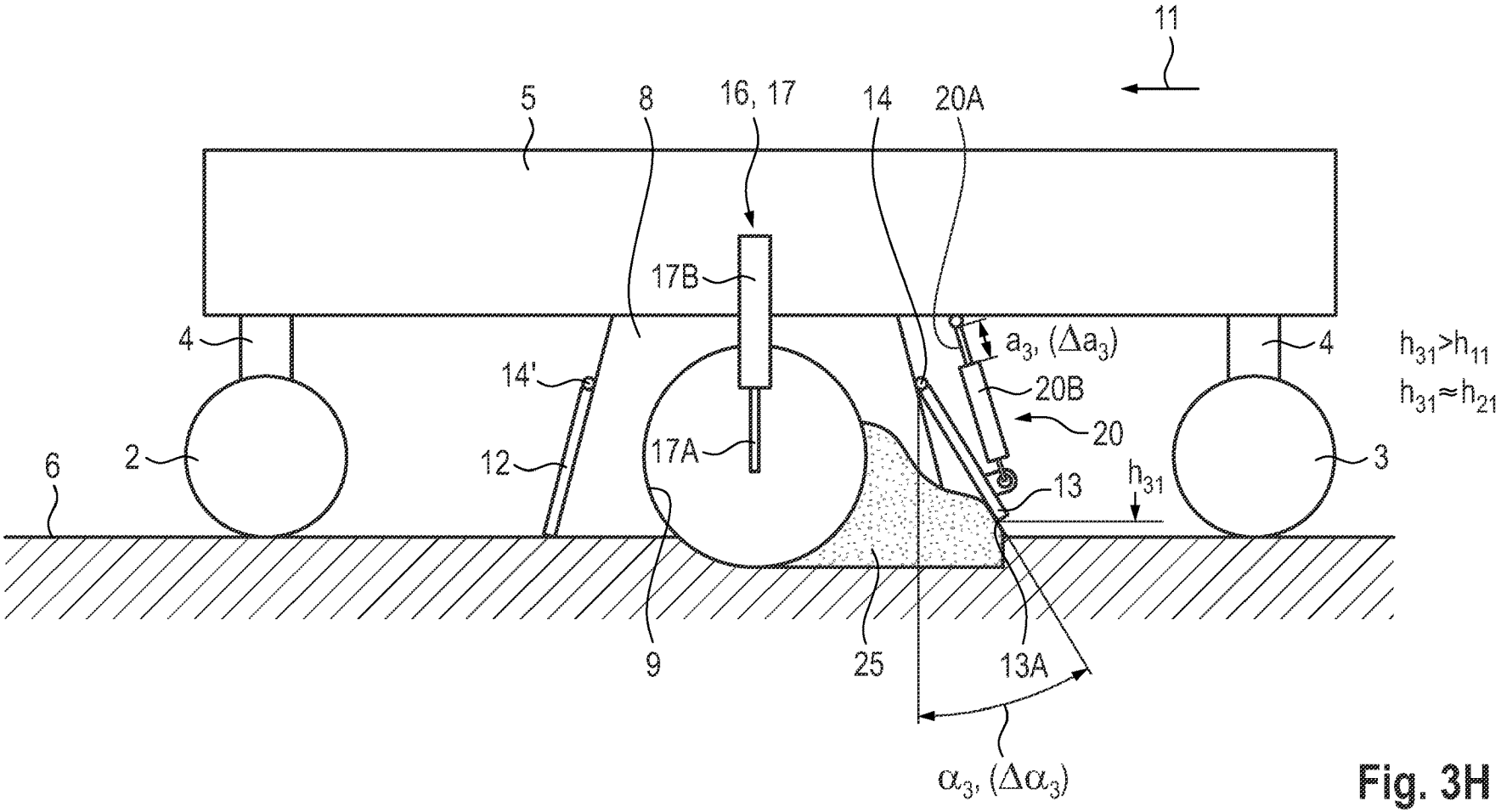

If the state of equilibrium shown in FIG. 3F has not yet been established, the rear roller flap 13 continues to exert a not inconsiderable counter-pressure on the material, so that material can continue to accumulate. This applies to both starting and increasing the milling depth. In this case, another roller flap position correction cycle is carried out. The roller flap position correction cycles are carried out until it is determined that the state of equilibrium shown in FIG. 3F has been established. For this purpose, the roller flap position correction cycle of the roller flap position correction mode includes a checking routine.

To carry out the checking routine, in one embodiment the control device 21 of the roller flap adjustment device 19 is configured in such a way that, on the basis of a comparison of the value of the variable correlating with the third pivoted position, which in the present embodiment is the distance $\Delta a$, with a threshold value, a state of equilibrium is inferred. Taking the dynamic conditions into account, different threshold values can be defined, which can be stored in the memory 27 and can be read out by the control and computing unit 21A of the control device 21 of the roller flap adjustment device 19.

For this check, the control device detects the distance $\Delta a_3$ that the piston 20A of the piston-cylinder arrangement 20 of the roller flap adjustment device 19 has travelled when pivoting from the second into the third pivoted position (FIG. 3G, 3H). The distance $\Delta a_3$ is measured when a predetermined time interval has elapsed after the floating position has been reset or the ground milling machine has covered a predetermined distance. For this purpose, the timer 21AA, which specifies a predetermined time interval, or the odometer 21AB is started. However, other timers or odometers can also be provided. The time interval or the distance for the check can be different from the time interval or the distance for the automatic activation of the roller flap position correction mode.

If the distance $\Delta a_3$ is less than the threshold value or equal to the threshold value, i.e. the roller flap 13, as shown in FIGS. 3G and 3H, has not fallen back by a minimum amount from the second pivot position, a state of equilibrium is not inferred and the roller flap position correction cycle is repeated. For this purpose, the control device 21 of the roller flap adjustment device 19 again controls the piston-cylinder arrangement 20 thereof in such a way that the first and second steps described above are carried out. The floating position is switched off and the rear roller flap 13 is pivoted upwards out of a first pivoted position (FIG. 3I), in which the rear roller flap rests floating on the milled material 25 ($h_{12}$), into a second pivoted position (FIG. 3J) ($h_{22}$). For this purpose, the piston 20A of the piston-cylinder arrangement 20 of the roller flap adjustment device 19 is retracted by a predetermined distance Δa. The floating position is then switched on again, so that the rear roller flap 13 falls into a third pivoted position ($h_{32}$) (FIG. 3K).

The control device again detects the distance Δa that the piston 20A of the piston-cylinder arrangement 20 of the roller flap adjustment device 19 has retracted during pivoting from the second into the third pivoted position. The checking routine described above is then carried out again.

Figure 3I:
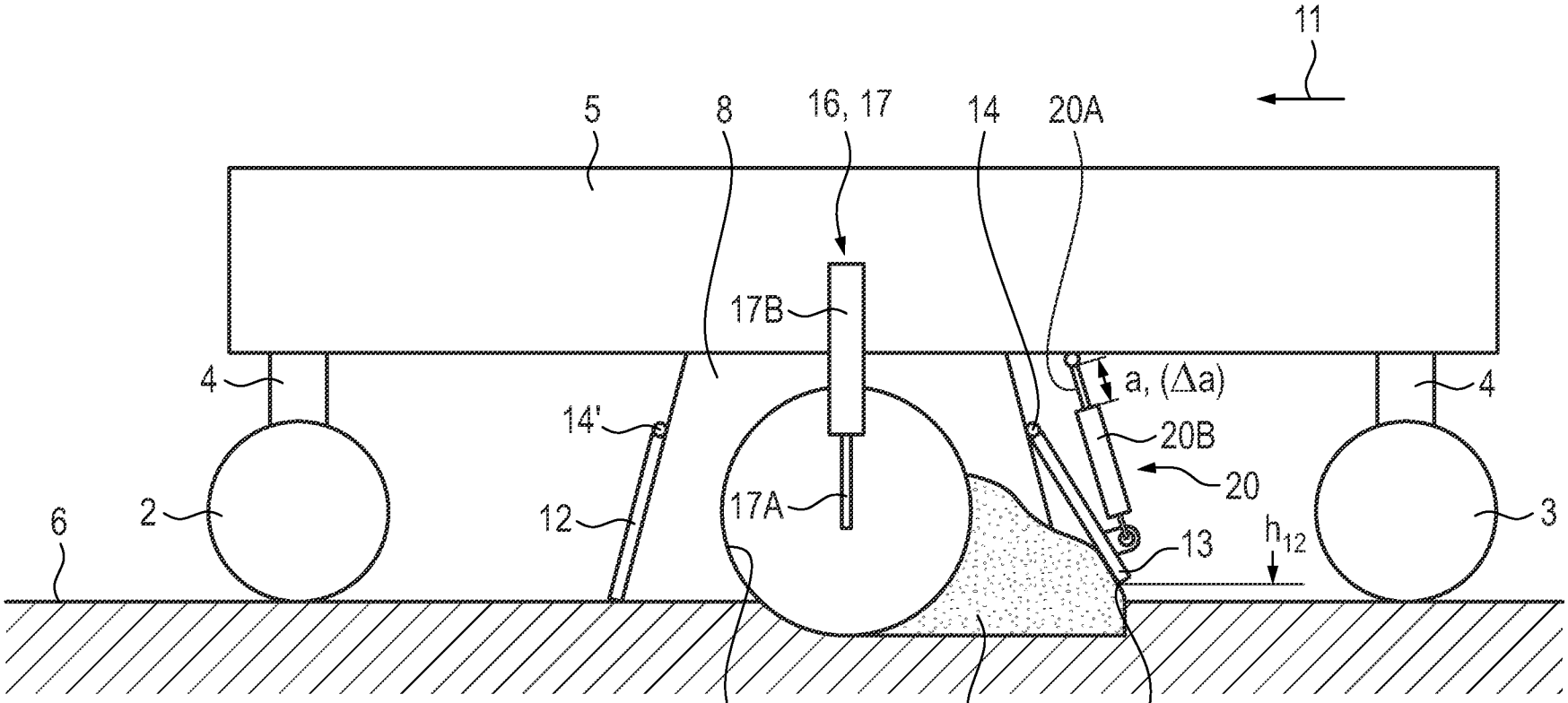
Figure 3J:
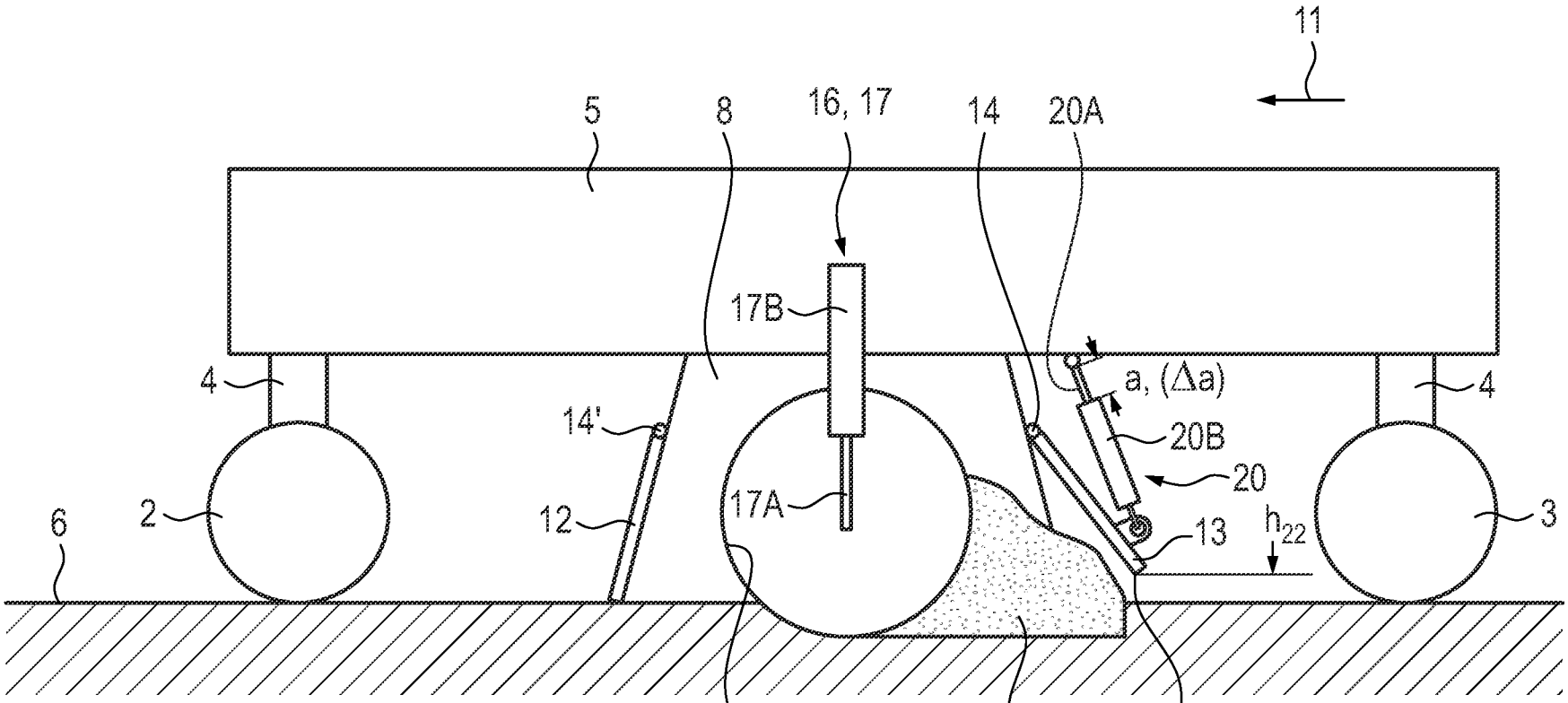
Figure 3K:
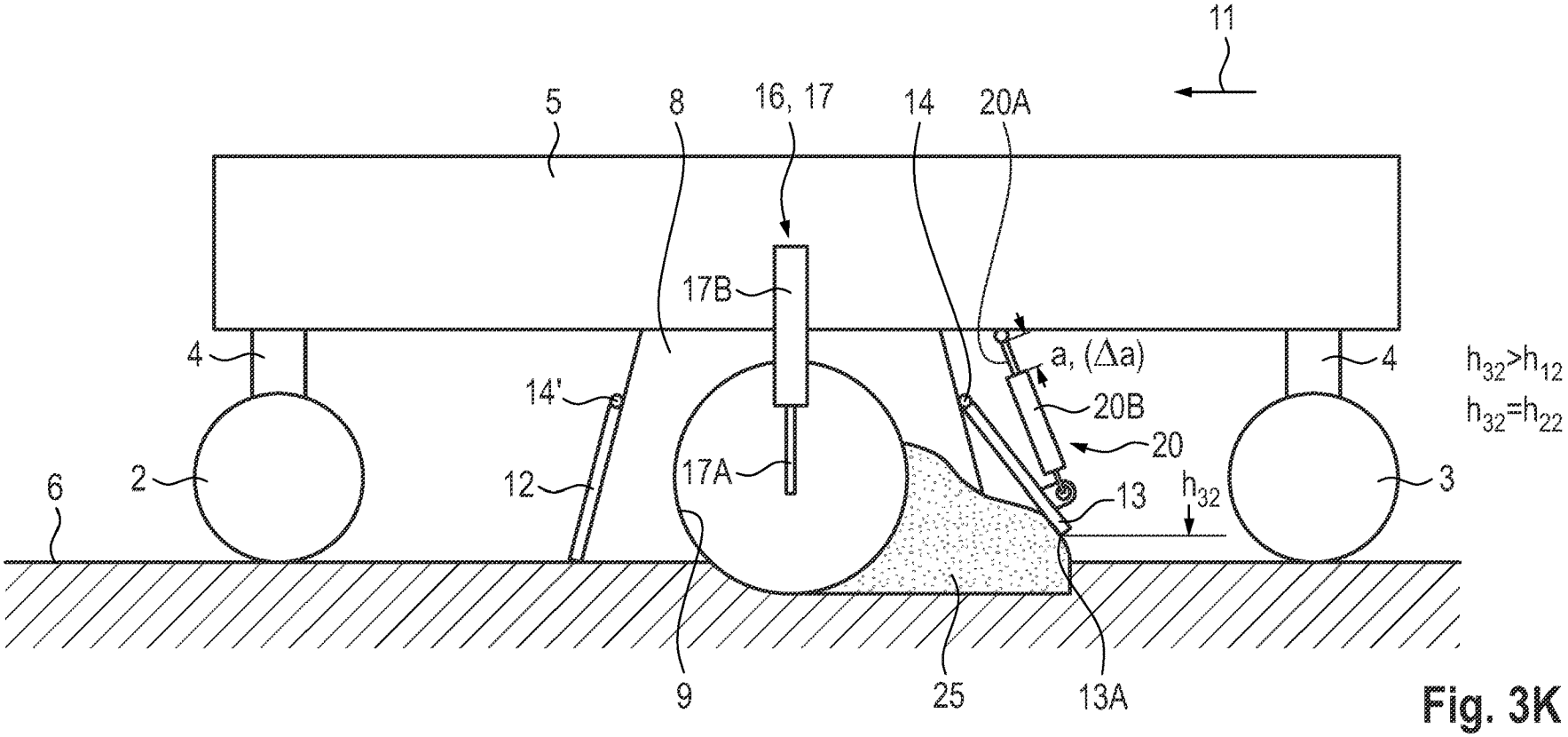

If the distance Δa is less than or equal to the threshold, i.e. the roller flap 13, as shown in FIGS. 3I to 3K, has not fallen back by a minimum amount from the second pivoting position, a state of equilibrium is not inferred and the checking cycle is repeated. If, on the other hand, the distance Δa is greater than the threshold value, i.e. the roller flap has fallen back, a state of equilibrium is inferred. The checking cycle is repeated until the state of equilibrium shown in FIG. 3F has been established, i.e. it has been determined that the distance Δa is greater than the threshold value.

Figure 3L:
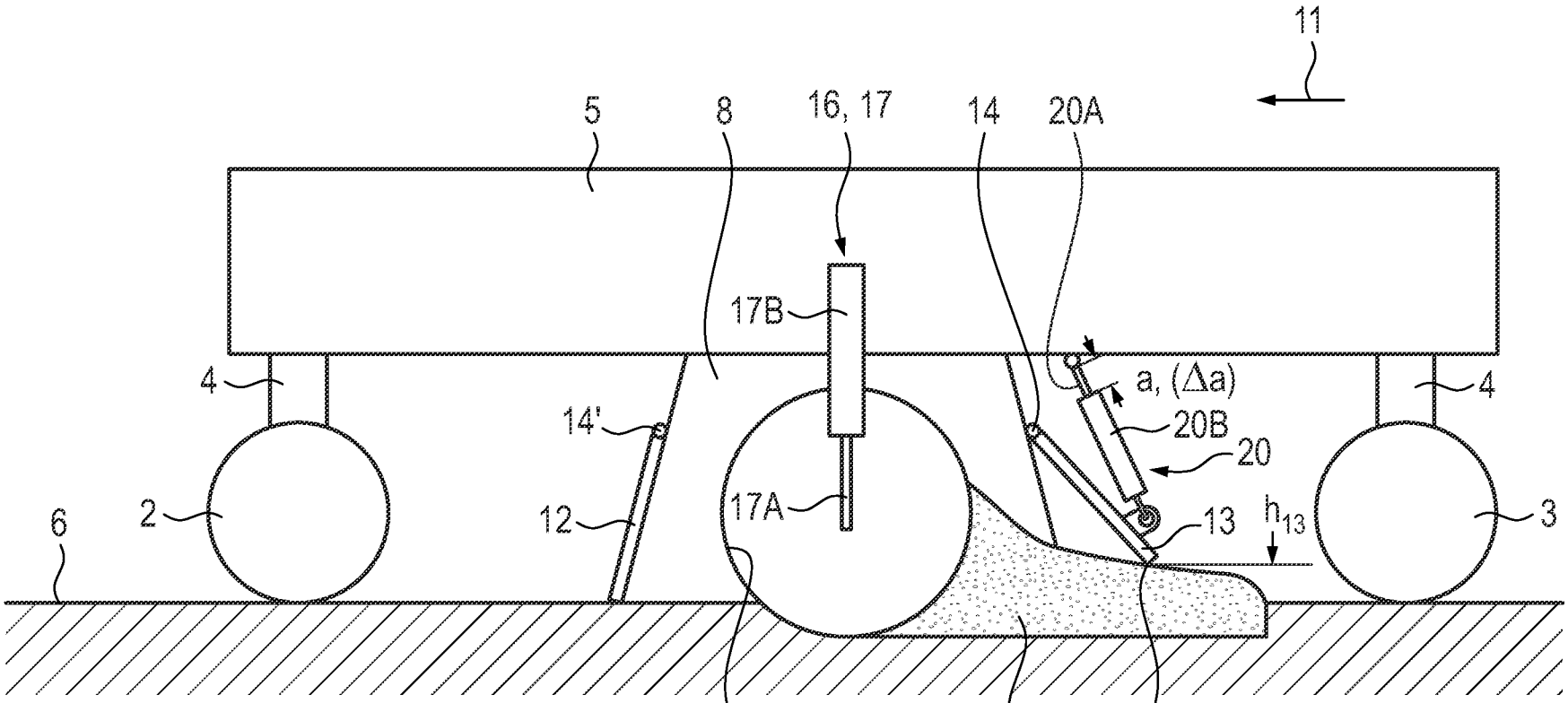
Figure 3M:
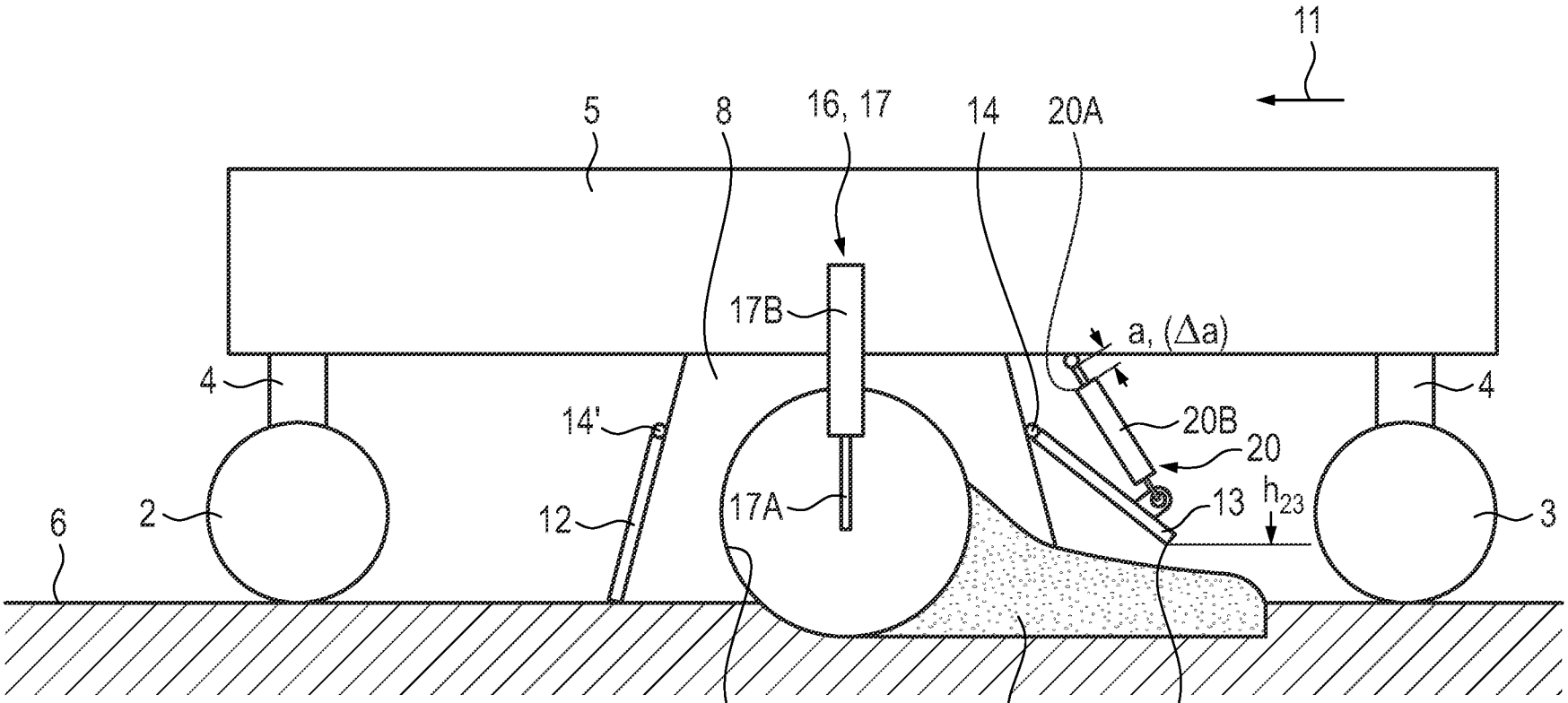
Figure 3N:
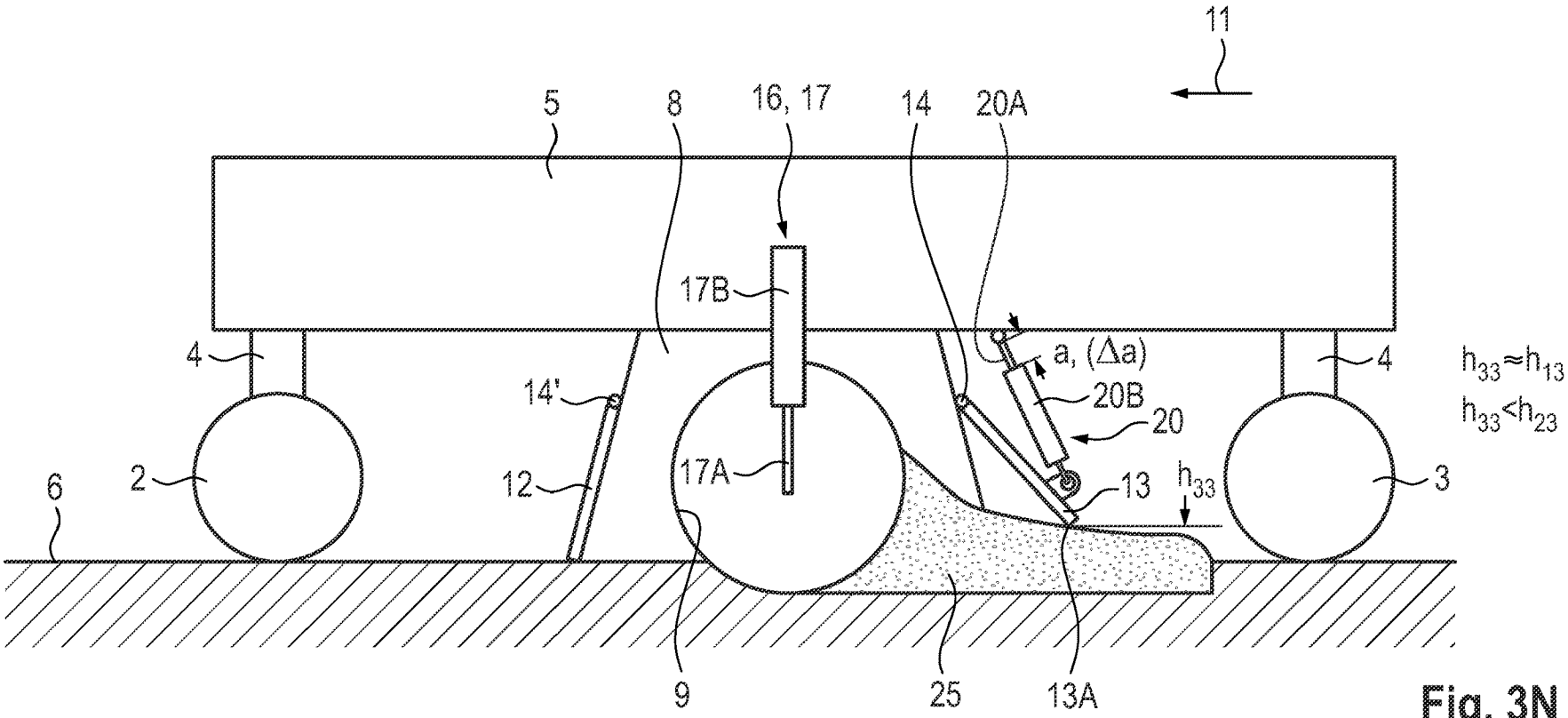

FIG. 3L shows the first pivoted position ($h_{13}$), FIG. 3M shows the second pivoted position ($h_{23}$) and FIG. 3N shows the third pivoted position ($h_{33}$) of a further roller flap position correction cycle. It can be seen that the roller flap 13 falls by a relatively large amount, with the distance Δa being greater than the threshold value, so that a state of equilibrium can be inferred ($h_{33}<h_{23}$). The roller flap position correction mode is then deactivated. In an alternative embodiment, however, the roller flap position correction mode is not yet deactivated if it is determined only once that the distance Δa is greater than the threshold value. Rather, another checking cycle is performed to check whether the roller flap falls back again by an amount that is greater than the threshold value.

In a particularly preferred embodiment, a state of equilibrium is inferred on the basis of a comparison of the value of the variable correlating with the third pivoted position (FIG. 3H), which in the present embodiment is the distance $a_3$ or $\Delta a_3$, with the value of the variable correlating with the first pivoted position (FIG. 3E), which is the distance $a_1$ or $\Delta a_1$ in the present embodiment. If a state of equilibrium has been determined at least once, the checking routine is terminated and the roller flap position correction mode is deactivated. Otherwise, a further checking cycle is performed. In this embodiment, the control device 21 of the roller flap adjustment device 19 is configured in such a way that the distance Δa (hereinafter designated as ΔA) by which the piston 20A of the piston-cylinder arrangement 20 of the roller flap adjustment device 19 is retracted to raise the rear roller flap 13 is compared with the distance Δa (hereinafter designated as ΔB) by which the piston of the piston-cylinder arrangement is extended when the rear roller flap falls back, i.e. the amount by which the roller flap is raised is compared with the amount by which the milling/mixing roller falls back. The controller performs another roller flap position correction mode when the distance ΔB is less than the distance ΔA. The roller flap position correction mode is deactivated when it is determined that the distance ΔB is equal to the distance ΔA or is greater than the distance AA. The roller flap thus remains in the floating position and is pulled, floating, over the surface of the milled ground. In an alternative embodiment, the roller flap position correction mode is only deactivated when the distance ΔB is equal to or greater than the distance ΔA in at least two consecutive roller flap position correction cycles.

FIG. 3G and FIG. 3J show the rear roller flap 13 in the second pivoting position and FIG. 3H to FIG. 3K show that the roller flap has pivoted upwards in relation to the first pivoted position into the third pivoted position ($h_{31}>h_{11}$ or $h_{32}>h_{12}$), since in the meantime material has flowed in, i.e. after a predetermined time interval has elapsed or after a predetermined distance has been covered the roller flap has been lowered by an amount that is less than the amount by which the roller flap was raised, which is determined by comparing the recorded distances ΔA and ΔB. The height of the lower edge 13A of the roller flap 13 is higher in the third pivoted position (FIG. 3H or FIG. 3K) than before it is raised (FIG. 3E or FIG. 3I). Consequently, a state of equilibrium for the material flow has not yet been established, so that a further checking cycle is carried out.

FIG. 3L to 3N show that the height of the lower edge 13A of the rear roller flap 13 in the third pivoted position (FIG. 3N) largely corresponds to the height of the roller flap in the first pivoted position (FIG. 3L), so that it is established that a state of equilibrium has been set.

The control device 21 of the roller flap adjustment device 19 can also be configured in such a way that the roller flap position correction mode can only be automatically activated again when the milling/mixing roller has been brought back into the zero position. This prevents the roller flap position correction mode from being activated automatically after the ground milling machine has only been at a temporary standstill.

The invention claimed is:

1. A ground milling machine for milling a ground surface, comprising:

a machine frame having a longitudinal direction;

a milling or mixing roller supported from the machine frame;

a roller housing, the milling or mixing roller being received in the roller housing, the roller housing being open at a bottom of the roller housing and including a rear roller flap at a rear of the roller housing relative to a working direction, the rear roller flap being pivotable about a pivot axis transverse to the longitudinal direction of the machine frame;

at least one actuator configured to pivot the rear roller flap about the pivot axis; and a controller operably associated with the actuator and configured to control the actuator so that a lower edge of the rear roller flap is adjustable in height relative to the ground surface, the controller being configured to control the actuator such that the rear roller flap in a floating mode rests on the ground surface with a predetermined contact force, the controller being further configured to provide an activatable roller flap position correction mode including at least one roller flap position correction cycle wherein:

in a first step the floating position of the rear roller flap is cancelled, and the rear roller flap is pivoted upwards out of a first pivoted position into a second pivoted position so that the lower edge of the rear roller flap is raised; and in a second step, after the rear roller flap is pivoted into the second pivoted position, the rear roller flap is again placed in the floating mode so that the rear roller flap is pivoted into a third pivoted position in which the lower edge of the rear roller flap again rests on the ground surface;

wherein the controller is further configured such that:

the at least one roller flap position correction cycle includes a checking routine wherein a value of a variable correlating with the third pivoted position is compared with a threshold value or with a value correlating with the first pivoted position, and wherein the roller flap position correction mode is deactivated based on the comparison of the value of the variable correlating with the third pivoted position with the threshold value or with the value correlating with the first pivoted position;

the variable correlating with the first and third pivoted positions is a variable correlating with the height of the lower edge of the rear roller flap above the ground surface; and the roller flap position correction cycle is repeated until it is determined at least once that the height of the lower edge of the rear roller flap in the third pivoted position is equal to or less than the threshold value or the height of the lower edge of the rear roller flap in the first pivoted position.

2. The ground milling machine of claim 1, wherein the controller is further configured such that:

the roller flap position correction cycle is repeated until it is determined at least twice that the height of the lower edge of the rear roller flap in the third pivoted position is equal to or less than the threshold value or the height of the lower edge of the rear roller flap in the first pivoted position.

3. The ground milling machine of claim 1, further comprising:

an operating element configured such that a human operator may manually activate the roller flap position correction mode by engaging the operating element.

4. A ground milling machine for milling a ground surface, comprising:

a machine frame having a longitudinal direction;

a milling or mixing roller supported from the machine frame;

a roller housing, the milling or mixing roller being received in the roller housing, the roller housing being open at a bottom of the roller housing and including a rear roller flap at a rear of the roller housing relative to a working direction, the rear roller flap being pivotable about a pivot axis transverse to the longitudinal direction of the machine frame;

at least one actuator configured to pivot the rear roller flap about the pivot axis; and a controller operably associated with the actuator and configured to control the actuator so that a lower edge of the rear roller flap is adjustable in height relative to the ground surface, the controller being configured to control the actuator such that the rear roller flap in a floating mode rests on the ground surface with a predetermined contact force, the controller being further configured to provide an activatable roller flap position correction mode including at least one roller flap position correction cycle wherein:

in a first step the floating position of the rear roller flap is cancelled, and the rear roller flap is pivoted upwards out of a first pivoted position into a second pivoted position so that the lower edge of the rear roller flap is raised; and in a second step, after the rear roller flap is pivoted into the second pivoted position, the rear roller flap is again placed in the floating mode so that the rear roller flap is pivoted into a third pivoted position in which the lower edge of the rear roller flap again rests on the ground surface;

wherein the at least one actuator includes a piston-cylinder arrangement acting on the rear roller flap; and wherein the machine further includes a distance sensor configured to detect a position of a piston of the piston-cylinder arrangement.

5. A ground milling machine for milling a ground surface, comprising:

a machine frame having a longitudinal direction;

a milling or mixing roller supported from the machine frame;

a roller housing, the milling or mixing roller being received in the roller housing, the roller housing being open at a bottom of the roller housing and including a rear roller flap at a rear of the roller housing relative to a working direction, the rear roller flap being pivotable about a pivot axis transverse to the longitudinal direction of the machine frame;

at least one actuator configured to pivot the rear roller flap about the pivot axis; and a controller operably associated with the actuator and configured to control the actuator so that a lower edge of the rear roller flap is adjustable in height relative to the ground surface, the controller being configured to control the actuator such that the rear roller flap in a floating mode rests on the ground surface with a predetermined contact force, the controller being further configured to provide an activatable roller flap position correction mode including at least one roller flap position correction cycle wherein:

in a first step the floating position of the rear roller flap is cancelled, and the rear roller flap is pivoted upwards out of a first pivoted position into a second pivoted position so that the lower edge of the rear roller flap is raised; and in a second step, after the rear roller flap is pivoted into the second pivoted position, the rear roller flap is again placed in the floating mode so that the rear roller flap is pivoted into a third pivoted position in which the lower edge of the rear roller flap again rests on the ground surface;

wherein the controller is further configured such that in the second step, the rear roller flap is placed in the floating mode after a predetermined time interval has elapsed after the floating mode has been cancelled in the first step or after a predetermined distance has been covered after the floating mode has been cancelled in the first step.

6. A ground milling machine for milling a ground surface, comprising:

a machine frame having a longitudinal direction;

a milling or mixing roller supported from the machine frame;

a roller housing, the milling or mixing roller being received in the roller housing, the roller housing being open at a bottom of the roller housing and including a rear roller flap at a rear of the roller housing relative to a working direction, the rear roller flap being pivotable about a pivot axis transverse to the longitudinal direction of the machine frame;

at least one actuator configured to pivot the rear roller flap about the pivot axis; and a controller operably associated with the actuator and configured to control the actuator so that a lower edge of the rear roller flap is adjustable in height relative to the ground surface, the controller being configured to control the actuator such that the rear roller flap in a floating mode rests on the ground surface with a predetermined contact force, the controller being further configured to provide an activatable roller flap position correction mode including at least one roller flap position correction cycle wherein:

in a first step the floating position of the rear roller flap is cancelled, and the rear roller flap is pivoted upwards out of a first pivoted position into a second pivoted position so that the lower edge of the rear roller flap is raised; and in a second step, after the rear roller flap is pivoted into the second pivoted position, the rear roller flap is again placed in the floating mode so that the rear roller flap is pivoted into a third pivoted position in which the lower edge of the rear roller flap again rests on the ground surface;

wherein the controller is further configured such that in the second step, the rear roller flap is placed in the floating mode after a predetermined time interval has elapsed after the rear roller flap has been pivoted into the second pivoted position in the first step or after a predetermined distance has been covered after the rear roller flap has been pivoted into the second pivoted position in the first step.

7. A ground milling machine for milling a ground surface, comprising:

a machine frame having a longitudinal direction;

a milling or mixing roller supported from the machine frame;

a roller housing, the milling or mixing roller being received in the roller housing, the roller housing being open at a bottom of the roller housing and including a rear roller flap at a rear of the roller housing relative to a working direction, the rear roller flap being pivotable about a pivot axis transverse to the longitudinal direction of the machine frame;

at least one actuator configured to pivot the rear roller flap about the pivot axis;

a controller operably associated with the actuator and configured to control the actuator so that a lower edge of the rear roller flap is adjustable in height relative to the ground surface, the controller being configured to control the actuator such that the rear roller flap in a floating mode rests on the ground surface with a predetermined contact force, the controller being further configured to provide an activatable roller flap position correction mode including at least one roller flap position correction cycle wherein:

in a first step the floating position of the rear roller flap is cancelled, and the rear roller flap is pivoted upwards out of a first pivoted position into a second pivoted position so that the lower edge of the rear roller flap is raised; and in a second step, after the rear roller flap is pivoted into the second pivoted position, the rear roller flap is again placed in the floating mode so that the rear roller flap is pivoted into a third pivoted position in which the lower edge of the rear roller flap again rests on the ground surface;

a memory in which a pivot angle by which the rear roller flap is pivoted out of the first pivoted position into the second pivoted position is stored for different milling depths; and the controller is further configured such that the pivot angle is read from the memory depending on a set milling depth.

8. A ground milling machine for milling a ground surface, comprising:

a machine frame having a longitudinal direction;

a milling or mixing roller supported from the machine frame;

a roller housing, the milling or mixing roller being received in the roller housing, the roller housing being open at a bottom of the roller housing and including a rear roller flap at a rear of the roller housing relative to a working direction, the rear roller flap being pivotable about a pivot axis transverse to the longitudinal direction of the machine frame;

at least one actuator configured to pivot the rear roller flap about the pivot axis; and a controller operably associated with the actuator and configured to control the actuator so that a lower edge of the rear roller flap is adjustable in height relative to the ground surface, the controller being configured to control the actuator such that the rear roller flap in a floating mode rests on the ground surface with a predetermined contact force, the controller being further configured to provide an activatable roller flap position correction mode including at least one roller flap position correction cycle wherein:

in a first step the floating position of the rear roller flap is cancelled, and the rear roller flap is pivoted upwards out of a first pivoted position into a second pivoted position so that the lower edge of the rear roller flap is raised; and in a second step, after the rear roller flap is pivoted into the second pivoted position, the rear roller flap is again placed in the floating mode so that the rear roller flap is pivoted into a third pivoted position in which the lower edge of the rear roller flap again rests on the ground surface;

wherein the controller is further configured such that:

the roller flap position correction mode is automatically activated when the ground milling machine has covered a predetermined distance after starting up of the ground milling machine; or the roller flap position correction mode is automatically activated when a predetermined time interval has elapsed after starting up of the ground milling machine.

9. A ground milling machine for milling a ground surface, comprising:

a machine frame having a longitudinal direction;

a milling or mixing roller supported from the machine frame;

a roller housing, the milling or mixing roller being received in the roller housing, the roller housing being open at a bottom of the roller housing and including a rear roller flap at a rear of the roller housing relative to a working direction, the rear roller flap being pivotable about a pivot axis transverse to the longitudinal direction of the machine frame;

at least one actuator configured to pivot the rear roller flap about the pivot axis;

a controller operably associated with the actuator and configured to control the actuator so that a lower edge of the rear roller flap is adjustable in height relative to the ground surface, the controller being configured to control the actuator such that the rear roller flap in a floating mode rests on the ground surface with a predetermined contact force, the controller being further configured to provide an activatable roller flap position correction mode including at least one roller flap position correction cycle wherein:

in a first step the floating position of the rear roller flap is cancelled, and the rear roller flap is pivoted upwards out of a first pivoted position into a second pivoted position so that the lower edge of the rear roller flap is raised; and in a second step, after the rear roller flap is pivoted into the second pivoted position, the rear roller flap is again placed in the floating mode so that the rear roller flap is pivoted into a third pivoted position in which the lower edge of the rear roller flap again rests on the ground surface;

a milling or mixing roller adjustment actuator configured such that a height of the milling or mixing roller relative to the machine frame can be adjusted so that a milling depth can be adjusted; and wherein the controller is further configured such that the roller flap position correction mode is automatically activated when the milling depth of the milling roller has been increased by a predetermined value during a milling operation and a predetermined time interval has elapsed after the increase in milling depth or the ground milling machine has covered a predetermined distance after the increase in milling depth.

10. A method of operating a ground milling machine, the ground milling machine including a machine frame, a roller housing having an open bottom and including a rear roller flap pivotable about a pivot axis extending transversely to a longitudinal direction of the machine frame so that a lower edge of the rear roller flap is adjustable in height relative to a ground surface, a milling roller received in the roller housing, the rear roller flap having a floating mode in which the lower edge of the rear roller flap rests on the ground surface, the method comprising:

activating a roller flap correction mode of a controller, the roller flap correction mode including at least one roller flap position correction cycle including:

(a) cancelling the floating mode of the rear roller flap, and pivoting the rear roller flap upwards from a first pivoted position into a second pivoted position such that the lower edge of the rear roller flap is raised; and (b) after the rear roller flap is in the second pivoted position, again activating the floating mode of the rear roller flap such that the rear roller flap is pivoted to a third pivoted position in which the lower edge of the rear roller flap again rests on the ground surface wherein the at least one roller flap position correction cycle includes a checking routine including:

comparing a value of a variable correlating with the third pivoted position with a threshold value or with a value correlating with the first pivoted position, and deactivating the roller flap position correction mode based on the comparing of the value of the variable correlating with the third pivoted position with the threshold value or with the value correlating with the first pivoted position;

wherein the variable correlating with the first and third pivoted positions is a variable correlating with the height of the lower edge of the rear roller flap above the ground surface; and wherein the checking routine includes repeating the roller flap position correction cycle until it is determined at least once that the height of the lower edge of the rear roller flap in the third pivoted position is equal to or less than the height of the lower edge of the rear roller flap in the first pivoted position.

11. The method of claim 10, further comprising:

manually activating the roller flap correction mode by manually engaging an operating element.

12. A method of operating a ground milling machine, the ground milling machine including a machine frame, a roller housing having an open bottom and including a rear roller flap pivotable about a pivot axis extending transversely to a longitudinal direction of the machine frame so that a lower edge of the rear roller flap is adjustable in height relative to a ground surface, a milling roller received in the roller housing, the rear roller flap having a floating mode in which the lower edge of the rear roller flap rests on the ground surface, the method comprising:

activating a roller flap correction mode of a controller, the roller flap correction mode including at least one roller flap position correction cycle including:

(a) cancelling the floating mode of the rear roller flap, and pivoting the rear roller flap upwards from a first pivoted position into a second pivoted position such that the lower edge of the rear roller flap is raised; and (b) after the rear roller flap is in the second pivoted position, again activating the floating mode of the rear roller flap such that the rear roller flap is pivoted to a third pivoted position in which the lower edge of the rear roller flap again rests on the ground surface;

wherein in step (b) the floating mode is activated after a predetermined time interval has elapsed or after a predetermined distance has been covered after the floating mode has been cancelled in step (a).

13. A method of operating a ground milling machine, the ground milling machine including a machine frame, a roller housing having an open bottom and including a rear roller flap pivotable about a pivot axis extending transversely to a longitudinal direction of the machine frame so that a lower edge of the rear roller flap is adjustable in height relative to a ground surface, a milling roller received in the roller housing, the rear roller flap having a floating mode in which the lower edge of the rear roller flap rests on the ground surface, the method comprising:

activating a roller flap correction mode of a controller, the roller flap correction mode including at least one roller flap position correction cycle including:

(a) cancelling the floating mode of the rear roller flap, and pivoting the rear roller flap upwards from a first pivoted position into a second pivoted position such that the lower edge of the rear roller flap is raised; and (b) after the rear roller flap is in the second pivoted position, again activating the floating mode of the rear roller flap such that the rear roller flap is pivoted to a third pivoted position in which the lower edge of the rear roller flap again rests on the ground surface;

wherein in step (b) the floating mode is activated after a predetermined time interval has elapsed or after a predetermined distance has been covered after the rear roller flap has been pivoted into the second pivoted position in step (a).

14. A method of operating a ground milling machine, the ground milling machine including a machine frame, a roller housing having an open bottom and including a rear roller flap pivotable about a pivot axis extending transversely to a longitudinal direction of the machine frame so that a lower edge of the rear roller flap is adjustable in height relative to a ground surface, a milling roller received in the roller housing, the rear roller flap having a floating mode in which the lower edge of the rear roller flap rests on the ground surface, the method comprising:

activating a roller flap correction mode of a controller, the roller flap correction mode including at least one roller flap position correction cycle including:

(a) cancelling the floating mode of the rear roller flap, and pivoting the rear roller flap upwards from a first pivoted position into a second pivoted position such that the lower edge of the rear roller flap is raised; and (b) after the rear roller flap is in the second pivoted position, again activating the floating mode of the rear roller flap such that the rear roller flap is pivoted to a third pivoted position in which the lower edge of the rear roller flap again rests on the ground surface;

storing in a memory a pivot angle by which the rear roller flap is pivoted out of the first pivoted position into the second pivoted position as a function of a set milling depth; and reading the pivot angle from the memory depending on the set milling depth.

15. A method of operating a ground milling machine, the ground milling machine including a machine frame, a roller housing having an open bottom and including a rear roller flap pivotable about a pivot axis extending transversely to a longitudinal direction of the machine frame so that a lower edge of the rear roller flap is adjustable in height relative to a ground surface, a milling roller received in the roller housing, the rear roller flap having a floating mode in which the lower edge of the rear roller flap rests on the ground surface, the method comprising:

activating a roller flap correction mode of a controller, the roller flap correction mode including at least one roller flap position correction cycle including:

(a) cancelling the floating mode of the rear roller flap, and pivoting the rear roller flap upwards from a first pivoted position into a second pivoted position such that the lower edge of the rear roller flap is raised; and (b) after the rear roller flap is in the second pivoted position, again activating the floating mode of the rear roller flap such that the rear roller flap is pivoted to a third pivoted position in which the lower edge of the rear roller flap again rests on the ground surface;

wherein in step (b):

the roller flap position correction mode is automatically activated when the ground milling machine has covered a predetermined distance after starting up of the ground milling machine; or the roller flap position correction mode is automatically activated when a predetermined time interval has elapsed after starting up of the ground milling machine.

16. A method of operating a ground milling machine, the ground milling machine including a machine frame, a roller housing having an open bottom and including a rear roller flap pivotable about a pivot axis extending transversely to a longitudinal direction of the machine frame so that a lower edge of the rear roller flap is adjustable in height relative to a ground surface, a milling roller received in the roller housing, the rear roller flap having a floating mode in which the lower edge of the rear roller flap rests on the ground surface, the method comprising:

activating a roller flap correction mode of a controller, the roller flap correction mode including at least one roller flap position correction cycle including:

(a) cancelling the floating mode of the rear roller flap, and pivoting the rear roller flap upwards from a first pivoted position into a second pivoted position such that the lower edge of the rear roller flap is raised; and (b) after the rear roller flap is in the second pivoted position, again activating the floating mode of the rear roller flap such that the rear roller flap is pivoted to a third pivoted position in which the lower edge of the rear roller flap again rests on the ground surface;

wherein in step (b) the roller flap position correction mode is automatically activated when a milling depth of the milling roller has been increased by a predetermined value during a milling operation and a predetermined time interval has elapsed after the increase in milling depth or the ground milling machine has covered a predetermined distance after the increase in milling depth.

* * * * *